US009533191B2

(12) United States Patent
Carbone et al.

(10) Patent No.: US 9,533,191 B2
(45) Date of Patent: Jan. 3, 2017

(54) AGILITY AND STRENGTH IMPROVEMENT APPARATUS

(71) Applicants: Alison M. Carbone, Kinnelon, NJ (US); Andrew Ruiz, Morris Township, NJ (US)

(72) Inventors: Michael G Carbone, Kinnelon, NJ (US); Andrew Ruiz, Morris Township, NJ (US)

( * ) Notice: Subject to any disclaimer, the term of this patent is extended or adjusted under 35 U.S.C. 154(b) by 0 days.

(21) Appl. No.: 14/666,481

(22) Filed: Mar. 24, 2015

(65) Prior Publication Data

US 2015/0190679 A1 Jul. 9, 2015

Related U.S. Application Data

(63) Continuation-in-part of application No. 14/321,916, filed on Jul. 2, 2014.

(60) Provisional application No. 61/886,708, filed on Oct. 4, 2013, provisional application No. 61/842,537, filed on Jul. 3, 2013.

(51) Int. Cl.

| | |
|---|---|
| ***A63B 22/14*** | (2006.01) |
| ***A63B 26/00*** | (2006.01) |
| ***A63B 71/00*** | (2006.01) |
| ***A63B 21/055*** | (2006.01) |
| *A63B 71/02* | (2006.01) |

(52) U.S. Cl.

CPC ..... *A63B 26/003* (2013.01); *A63B 21/0552* (2013.01); *A63B 71/0009* (2013.01); *A63B 71/0036* (2013.01); *A63B 2026/006* (2013.01); *A63B 2071/026* (2013.01); *A63B 2209/00* (2013.01); *A63B 2225/62* (2013.01)

(58) Field of Classification Search

CPC ..... A63B 26/00; A63B 26/003; A63B 21/00; A63B 21/02; A63B 21/04; A63B 21/0442; A63B 21/055; A63B 21/0552; A63B 21/0555; A63B 21/0557; A63B 71/009; A63B 71/0054; A63B 2225/62; A63B 21/0407

USPC ..... 482/92, 121–130, 142, 146, 148

See application file for complete search history.

(56) References Cited

U.S. PATENT DOCUMENTS

| | | | |
|---|---|---|---|
| 4,601,469 | A | 7/1986 | Sasser, Jr. |
| 4,605,224 | A | 8/1986 | Torii |
| 4,759,542 | A | 7/1988 | Hudec |

(Continued)

FOREIGN PATENT DOCUMENTS

| | | | |
|---|---|---|---|
| DE | 202004011069 | U1 | 12/2004 |
| GB | 2391180 | A | 2/2004 |

(Continued)

OTHER PUBLICATIONS

PCT International Report on Patentability; PCT/US2014/045189; Date of Issuance Jan. 5, 2016; (5 pgs).

(Continued)

*Primary Examiner* — Stephen Crow
*Assistant Examiner* — Garrett Atkinson
(74) *Attorney, Agent, or Firm* — Gearhart Law LLC

(57) ABSTRACT

An exercise balance board may have at least a platform for a user supported by a resilient, air-filled partial sphere. It contains features which allow users of any size or fitness level to properly exercise muscle groups. The balance board allows a user to exercise upper and lower muscle extremity groups either individually or simultaneously.

15 Claims, 12 Drawing Sheets

(56) References Cited

U.S. PATENT DOCUMENTS

| | | | | |
|---|---|---|---|---|
| 4,787,630 | A * | 11/1988 | Watson | A63B 22/14 482/146 |
| 4,826,159 | A | 5/1989 | Hersey | |
| 5,048,823 | A | 9/1991 | Bean | |
| 5,147,266 | A | 9/1992 | Ricard | |
| 5,643,154 | A | 7/1997 | Awbrey et al. | |
| 5,795,277 | A | 8/1998 | Bruntmyer | |
| 5,897,474 | A * | 4/1999 | Romero | A63B 22/14 446/396 |
| 6,872,175 | B2 * | 3/2005 | Lin | A63B 21/0004 482/121 |
| 7,090,628 | B2 | 8/2006 | Badarneh | |
| 7,112,168 | B2 | 9/2006 | Dalebout et al. | |
| 7,264,580 | B2 | 9/2007 | Lu | |
| 7,357,766 | B2 * | 4/2008 | Langer | A63B 21/0004 482/146 |
| 7,357,767 | B2 | 4/2008 | Tsai | |
| 7,431,681 | B1 * | 10/2008 | St. Cyr | A63B 21/0552 482/121 |
| 7,601,107 | B2 * | 10/2009 | Maloy | A63B 23/1209 482/123 |
| 7,666,126 | B2 | 2/2010 | Rempe | |
| 7,806,807 | B2 | 10/2010 | Genua | |
| 7,811,217 | B2 | 10/2010 | Odien | |
| 7,892,151 | B2 | 2/2011 | Colk et al. | |
| 7,985,164 | B2 * | 7/2011 | Ashby | A63B 22/02 434/247 |
| 8,210,992 | B2 | 7/2012 | Barre et al. | |
| 8,357,077 | B2 | 1/2013 | Taylor | |
| 8,360,943 | B2 | 1/2013 | Smith | |
| 2004/0014571 | A1 | 1/2004 | Haynes | |
| 2004/0018924 | A1 * | 1/2004 | Szydlowski | A63B 21/0004 482/146 |
| 2004/0023766 | A1 * | 2/2004 | Slone | A63B 22/18 482/146 |
| 2004/0087421 | A1 * | 5/2004 | Lin | A63B 21/0004 482/146 |
| 2005/0170939 | A1 * | 8/2005 | Lin | A63B 26/003 482/148 |
| 2006/0217242 | A1 | 9/2006 | Karpachev | |
| 2007/0265138 | A1 * | 11/2007 | Ashby | A63B 22/02 482/8 |
| 2011/0143896 | A1 | 6/2011 | Senegal | |

FOREIGN PATENT DOCUMENTS

| | | | |
|---|---|---|---|
| GB | 2401558 | A | 11/2004 |
| RU | 119248 | U1 | 8/2012 |
| WO | 2015003032 | A1 | 1/2015 |

OTHER PUBLICATIONS

PCT International Search Report and Written Opinion; PCT/US2014/045189; Date of Mailing Dec. 4, 2014; (6 pgs).
GB1605119.5; Search Report dated May 26, 2016 (4 pages).

* cited by examiner

AGILITY AND STRENGTH IMPROVEMENT APPARATUS

CLAIM OF PRIORITY

This application claims priority to U.S. application Ser. No. 14/321,916 filed on Jul. 2, 2014 which claims priority to U.S. Application 61/886,708 filed on Oct. 4, 2013 and U.S. Application 61/842,537 filed on Jul. 3, 2013, the contents of each of which are fully incorporated herein by reference in its entirety.

FIELD OF THE INVENTION

This invention relates to physical therapy tools, in particular to equipment designed to aid individuals with increasing strength and balance.

BACKGROUND OF THE INVENTION

Exercise devices have been invented to address various situations. These devices share the general purpose of increasing strength, balance, or ability for a particular sport. Many of the devices incorporate a balance ball or half-ball of some sort, either with or without a board disposed on the ball, and with or without components that allow arm exercises. The devices are generally designed for average sized adults and are difficult to adjust to accommodate taller people, children or smaller than average adults. As far as the user's reach and ability to adjust the arm exercise portion of the devices, devices of this type currently on the market are not adjustable. They also may be limited in the types of exercises a user can do, and in the range of muscle groups that can be strengthened using the devices. Many of the more popular devices related to the current invention are not adjustable. The present invention has a unique feature in that it has a visual aid to allow a user to easily determine the level at which the balance ball component has been adjusted, and it allows a range of adjustments for arm exercises.

Examples of related art are described below:

U.S. Pat. No. 4,787,630 pertains to an exercise device including rotatably interconnected base and platform assemblies. The base assembly is adapted to rock back and forth on a floor or other horizontal surface and a person using the device stands, sits, kneels or lays on the platform assembly. The device is adjustable whereby the permitted range of movement can be widely varied. Ropes, springs, elastic cords or poles can be grasped by a person using the device for balance and for upper body exercise.

U.S. Pat. No. 7,112,168 pertains to balancing equipment that provides a selectively dynamic platform for an individual thereon. The weight and movement of the individual causes the platform to tilt in any direction, thereby attempting to throw off the balance of the individual, causing the individual to work on maintaining balance while on the dynamic platform. The dynamic nature of the platform can be adjusted to correspond to the balancing abilities of individuals. An adjustment mechanism increases or reduces the amount the platform is able to tilt, without requiring the raising or lowering of any component of the platform. An exercise mechanism can also be connected to the platform U.S. Patent Application 2004/0087421 pertains to an exercise balance trainer that includes a hard board and a resilient ball body connected to the board. The ball body has a first curved wall with a first rim, a second curved wall with a second rim connected fixedly to the first rim so as to define an air-receiving chamber between the first and second curved walls, and an annular flange connected to the board and a junction of the first and second rims. The first and second rims have the same diameter. The first curved wall has a maximum height that is not greater than one-half of the diameter of the first rim. The second curved wall has a maximum height that is not greater than one-third of the diameter of the second rim.

U.S. Patent Application 2011/0143896 pertains to an exercise device, and more particularly a combination balance and stability training and resistance training exercise device, comprising a platform and a balance element. The exercise device can also comprise one or more resilient, elongate resistance training elements for resistance training. The exercise device can be provided with a stabilizing device. When removed from the stabilizing device, the exercise device can be used in a manner similar to a conventional balance board. When mounted on the stabilizing device, the exercise device is supported in a stable orientation for performing exercises requiring a stable and balanced support surface.

None of the art described above addresses all of the issues that the present invention does. This invention includes a rigid elongated platform, similar to a snowboard platform, which is joined to a resilient balancing element. The user stands on the rigid elongated platform and moves in the manner desired for the exercise desired. The resilient balancing element is approximately a half-sphere made of a material such as rubber and is preferably filled with air. The pressure and therefore the level of exercise difficulty can be adjusted by adjusting the air volume.

The present invention is unique in many aspects. It can be easily adjusted for use by a variety of users, both in body size and shape and in age or fitness level. The present invention includes an attachment for a specialized handle, so it may be used by a handicapped person or by someone whose hand is crippled with arthritis. The present invention also allows a user to perform isolation techniques to stabilize or challenge a particular muscle group. No other device in the related art can do this for therapeutic or home use. In addition, the present invention allows a user to attach an auxiliary board, such as a snowboard, to the device. Thus an athlete can use his own snowboard to practice with and hone his technique.

The present invention also includes flexible elements with handles that a user can grasp with his hands for added balance or arm exercises. There are multiple flexible elements disposed in varying distances from the user's core, such that a user can choose the ones most appropriate to his arm length, exercise type, etc.

When compared with other devices of the same nature, the present invention provides a user with a larger surface area on which to plant his feet; this allows a user to practice the correct stance for any sport or activity. For instance, if a basketball player wants to strengthen his knees and practice a pivot type of movement with his feet spread on the device, he would have ample room to do so. Other devices in the art don't allow for this because they're not long enough. In addition, the present invention includes an embodiment that allows for lengthening the device, so a tall person could easily use it. This also enables a user to attach an auxiliary device, as the rigid elongated platform allows ample room for this, and is easily extendable if necessary.

Another feature that adds to the uniqueness of the present invention is the visual indicator of difficulty levels. The outer surface of the resilient balancing element has a series of patterns disposed on it. The patterns run horizontally across the surface and indicate the level and distribution of pressure in it. Thus, if a novice user desires a lower pressure so the resiliency is lessened, he can easily see from the patterns how inflated the resilient balancing element is. This may encourage a reluctant user to use the device, as he can more easily discern the level of difficulty. Although the related art has features that are adjustable, they are more difficult to adjust and it isn't easy to determine at a glance the level of the adjustment.

The adjustable feature of the resilient balancing element also allows it to be suitable for use by children, the elderly or a very weak person; the resilient balancing element can be deflated to a very low pressure for maximum ease of use, and the flexible elements with handles can also be employed. As the person gains strength and balance, the pressure and thus difficulty level in the resilient balancing element may also be increased.

Another feature of one embodiment of the invention that is unique to this type of device is a stability skirt. The skirt provides reassurance and stability for a user trying to balance or move on the invention.

Other unique features include sensors on the invention that can read a user's physical parameters through his or her feet while the user is standing on the platform and doing exercises. This allows the trainer or user to make real-time adjustments based on real-time measurements such as heart rate, and also to measure parameters such as BMI, weight, and percent body fat. The ability of the board to vibrate through the use of integral or removable vibration devices adds a therapeutic element for people with diseases such Parkinson's and cystic fibrosis, and it aids in increasing muscle growth.

The presence of multiple flexible elements disposed at differing distances, both horizontally and vertically along the rigid elongated platform, allows the user to choose flexible elements that are in the proper position for his arm reach and exercise. This allows the user to perform upper extremity movements in proper biomechanical form. The flexible nature of the flexible elements also decreases stress on the user's joints.

One difference between the present invention and the related art is evident in the placement of the multiple flexible elements in relation to the rigid elongated platform. None of the related art described above allows for matching the position of the flexible elements to the user's arm reach; thus, exercises may be done at the wrong angle and may cause injury, or may fail to exercise the desired muscle group in the desired manner.

The present invention thus solves a number of issues that other devices in the field don't, as it is novel and unique to the field.

SUMMARY OF THE INVENTION

The present invention is an exercise device for use in physical therapy, gym and home. In one embodiment there is an article of manufacture, comprising: a rigid elongated platform with a top side, a bottom side, a first end and a second end; a resilient balancing element having an inner surface, an outer surface, a top surface, a bottom surface, and a volume; said resilient balancing element top surface joined to said rigid elongated platform bottom side, and said resilient balancing element being adjustable in volume; one or more compartments disposed in said rigid elongated platform at the first end, and one or more compartments disposed in said rigid elongated platform at the second end; and one or more flexible elements being disposed in said compartments.

An additional embodiment may include additional compartments; one or more compartments disposed in said rigid elongated platform top first side, one or more compartments disposed in said rigid elongated platform top second side; and one or more flexible elements being connected to said compartments.

Another alternate embodiment may include: one or more compartments disposed in said rigid elongated platform at the first end, one or more compartments disposed in said rigid elongated platform at the second end, one or more compartments disposed in said rigid elongated platform top first side, and one or more compartments disposed in said rigid elongated platform top second side; and one or more flexible elements being connected to said compartments.

In another embodiment there is an article of manufacture having a rigid elongated platform with a top side, a bottom side, a first end and a second end, wherein said rigid elongated platform has a plurality of apertures extending along at least a part of a periphery of said rigid elongated platform; a resilient balancing element having an inner surface, an outer surface, a top surface, a bottom surface, and a volume, wherein said resilient balancing element top surface is coupled to said rigid elongated platform bottom side, and wherein said resilient balancing element being adjustable in volume; a stability base coupled to said outer surface of said resilient balancing element such that said resilient balancing element is positioned between said stability base and said rigid elongated platform, wherein the stability base has a plurality of stability bars that couple said stability base to said rigid elongated platform; and more than one attachment bars positioned at said first end and/or said second end of said rigid elongated platform.

In yet another embodiment of the present invention there is an article of manufacture having a rigid elongated platform having a top side, a bottom side, a first end, and a second end, wherein said rigid elongated platform has a plurality of apertures extending along at least a part of a periphery of said rigid elongated platform; a resilient balancing element having an inner surface, an outer surface, a top surface, a bottom surface, and a volume, wherein said resilient balancing element top surface is coupled to said rigid elongated platform bottom side, and wherein said resilient balancing element being adjustable in volume; a stability base coupled to said outer surface of said resilient balancing element such that said resilient balancing element is positioned between said stability base and said rigid elongated platform, wherein the stability base has a plurality of stability bars that couple said stability base to said rigid elongated platform, wherein rotation of at least one tension knob rotatably coupled to the stability base increases or decreases tension exhibited by one or more of said plurality of stability bars with respect to said rigid elongated platform; and a plurality of attachment bars positioned at said first end and/or said second end of said rigid elongated platform.

A user stands on the rigid elongated platform and performs movements to strengthen and condition his muscles, as well as movements to improve his balance. The resilient balancing element beneath the rigid elongated platform provides flexibility to encourage the user to move in ways that strengthen his body and improve his balance. The flexible elements are components that the user may grasp with his hands either to aid in balance or to add a further dimension to the exercises available through the use of the device.

It is an object of the invention to provide an exercise apparatus that allows a variety of users to perform exercises in the proper form.

It is an object of the invention to provide an exercise apparatus that can be used for physical therapy.

It is an object of the invention to provide an exercise apparatus that can be used for leg and arm strengthening simultaneously.

It is an object of the invention to provide an exercise apparatus that aids a user in improving balance.

It is an object of the invention to provide an exercise apparatus that aids a user in strengthening their core.

It is an object of the invention to be conformable to users of multiple fitness levels.

DESCRIPTION OF THE PREFERRED EMBODIMENTS

Figure 1:
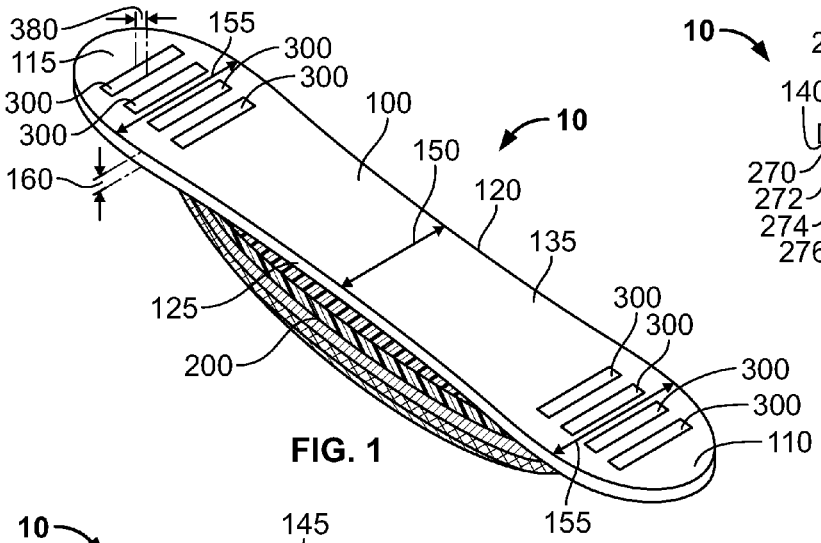
FIG. 1 shows a top perspective view of an embodiment of the invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

FIG. 1 shows exercise apparatus 10, rigid elongated platform 100, rigid elongated platform first end 110, rigid elongated platform second end 115, rigid elongated platform first side 120, rigid elongated platform second side 125, rigid elongated platform top side 135, rigid elongated platform narrowest width 150, rigid elongated platform widest width 155, rigid elongated platform depth 160, resilient balancing element 200, compartment 300 and compartment width 380.

The rigid elongated platform 100 is disposed on the resilient balancing element 200. The resilient balancing element may or may not have a top surface. If there is no top surface, the two components may be joined together in any manner, including but not limited to, gluing or fusing, or any method that will allow them to be joined. Alternately, the resilient balancing element 200 may have a top surface, and be a stand-alone device, which is then joined to the rigid elongated platform by any method, including but not limited to, gluing, fusing, stapling (if the top had an overhang that could be stapled to the rigid elongated platform), using an eye and hook closure such as, but not limited to, Velcro™, nailing or screwing, or any other method that would secure the resilient balancing element to the rigid elongated platform.

The rigid elongated platform is not a uniform width. The narrowest width 150 ranges from approximately 6 inches (15.2 cm), to approximately 36 inches (91.4 cm), with a preferred width of 6 to 14 inches (15.2 to 35.6 cm), with a more preferred width of 10 inches (25.4 cm). The widest width 155, shown the same on both the first end 110 and second end 115, ranges from 6.5 inches to 48 inches (16.5 to 121.9 cm), with a preferred width of 13 inches to 25 inches (33.0 to 63.5 cm), and a more preferred width of 17 inches (43.2 cm).

The rigid elongated platform depth 160 is such that it can accommodate the compartments 300 with compartment depths 320. The rigid elongated platform depth 160 ranges from approximately 0.5 inches to approximately 12 inches (2.54 to 30.5 cm), with a preferred depth of 2 inches to 6 inches (5.1 to 15.2 cm).

The rigid elongated platform length 145 will be discussed with FIG. 5; the compartments and compartment covers will be discussed in more detail with FIG. 7A.

The rigid elongated platform and the compartment covers may be made from materials including, but not limited to, plastic, such as but not limited to plexiglass or fiberglass; carbon fiber; synthetic fibers such as Kevlar™; wood, such as but not limited to hardwoods; metals such as but not limited to aluminum; graphene; composites; or any combination of these materials with each other or with other materials.

The resilient balancing element may be made from materials including, but not limited to, rubber, plastic, metal, glass such as but not limited to fiberglass, graphene, composites, or any combination of these materials with each other or with other materials.

Figure 2:
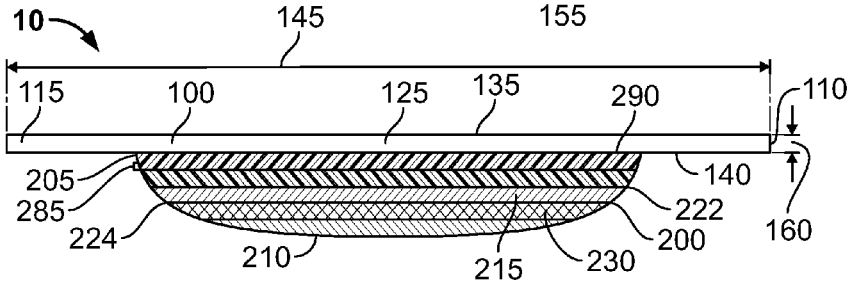
FIG. 2 shows a side view of the embodiment of FIG. 1.

FIG. 2 shows exercise apparatus 10, rigid elongated platform 100, rigid elongated platform first end 110, rigid elongated platform second end 115, rigid elongated platform second side 125, rigid elongated platform top side 135, rigid elongated platform bottom side 140, rigid elongated platform length 145, rigid elongated platform depth 160, resilient balancing element 200, resilient balancing element top surface 205, resilient balancing element bottom surface 210, resilient balancing element first side 215, resilient balancing element first end 222, resilient balancing element second end 224, resilient balancing element outer surface 230, valve 285 and rigid elongated platform and resilient balancing element union 290.

The valve 285 shown in FIG. 2 allows a user to adjust the volume of the resilient balancing element. The resilient balancing element is preferentially filled with air, but it may be filled with any substance, including but not limited to, water or other liquids, sand or other solids, or gels. The valve may include a gauge that allows the user to read the volume or pressure in the resilient balancing element. Alternately, a separate gauge may be employed if desired, similar to the pressure gauge one uses when filling auto tires with air.

Figure 3:
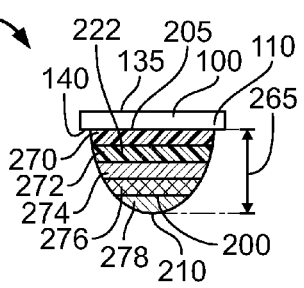
FIG. 3 shows a front view of the embodiment of FIG. 1.

FIG. 3 shows exercise apparatus 10, rigid elongated platform 100, rigid elongated platform first end 110, rigid elongated platform top side 135, rigid elongated platform bottom side 140, resilient balancing element 200, resilient balancing element top surface 205, resilient balancing element bottom surface 210, resilient balancing element first end 222, resilient balancing element depth 265, resilient balancing element first pattern 270, resilient balancing element second pattern 272, resilient balancing element third pattern 274, resilient balancing element fourth pattern 276 and resilient balancing element fifth pattern 278.

The resilient balancing element depth 265 is adjustable, depending on the amount of air or other substance in it. The depth 265 ranges from approximately 1 inch to approximately 48 inches (2.54 to 121.9 cm), with a preferred depth range of 2 inches to 36 inches (5.1 to 91.4 cm). The patterns 270, 272, 274, 276 and 278 on the resilient balancing element give the user, physical therapist, or trainer an estimate of the volume inside. As the volume is increased, the patterns expand and are fully visible; as the volume is decreased, the patterns contract and may be partially obscured. A lower volume causes the resilient balancing element to have less resilience, and therefore provides a less vigorous work out than a higher volume. If a user is hesitant to use the exercise apparatus, the trainer or therapist can visually show him the extent to which it has been deflated. Alternately, if the user wants the maximum work out possible, he can easily see that the exercise apparatus is fully inflated.

Figure 4:
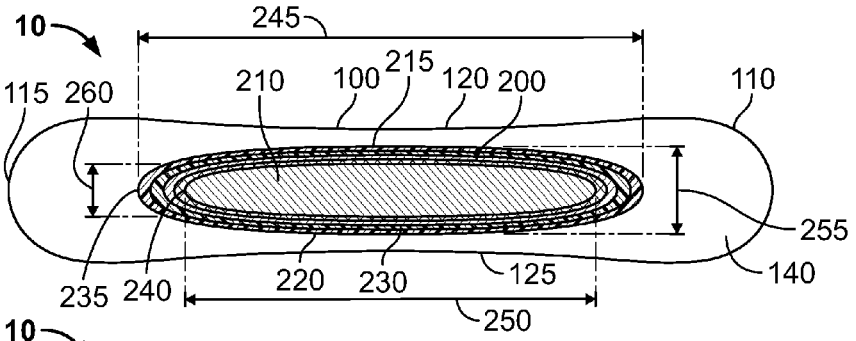
FIG. 4 shows a bottom view of the embodiment of FIG. 1.

FIG. 4 shows exercise apparatus 10. rigid elongated platform 100, rigid elongated platform first end 110, rigid elongated platform second end 115, rigid elongated platform first side 120, rigid elongated platform second side 125, rigid elongated platform bottom side 140, resilient balancing element 200, resilient balancing element bottom surface 210, resilient balancing element first side 215, resilient balancing element second side 220, resilient balancing element outer surface 230, resilient balancing element top perimeter 235, resilient balancing element bottom perimeter 240, resilient balancing element top length 245, resilient balancing element bottom length 250, resilient balancing element top width 255, and resilient balancing element bottom width 260.

FIG. 4 illustrates that the resilient balancing element 200 extends to cover a portion of the rigid elongated platform 110. The top perimeter 235 and the top length 245 are of dimensions such that the resilient balancing element can be disposed on the rigid elongated platform. The figures illustrate the resilient balancing element dimensions smaller than those of the rigid elongated platform; the resilient balancing element top perimeter 235 and top length 245 may be equal to the rigid elongated platform narrowest width 150 and rigid elongated platform length 145 (shown in FIG. 2), such that the resilient balancing element 200 covers the entire rigid elongated platform bottom side 140, or the resilient balancing element top perimeter 235 and top length 245 may be less than the rigid elongated platform narrowest width 150 and rigid elongated platform length 145, as shown in the figures.

The resilient balancing element 200 is roughly a half oval sphere. The resilient balancing element bottom length 250 is less than the top length 245, and the resilient balancing element bottom width 260 is less than the top width 255. The amount of surface area of the resilient balancing element bottom surface contacting the ground changes with the volume; less surface area contacts the ground at higher volumes than at lower volumes.

Because less surface area of the bottom surface is contacting the ground when the resilient balancing element volume is higher, more balance is required to control the exercise apparatus. As the resilient balancing element volume is decreased, more surface area of the bottom surface contacts the ground, making the exercise apparatus easier to control and requiring less balance control. Thus, the adjustable volume of the resilient balancing element allows the exercise apparatus to be effectively employed by users of many different athletic capabilities.

Figure 5:
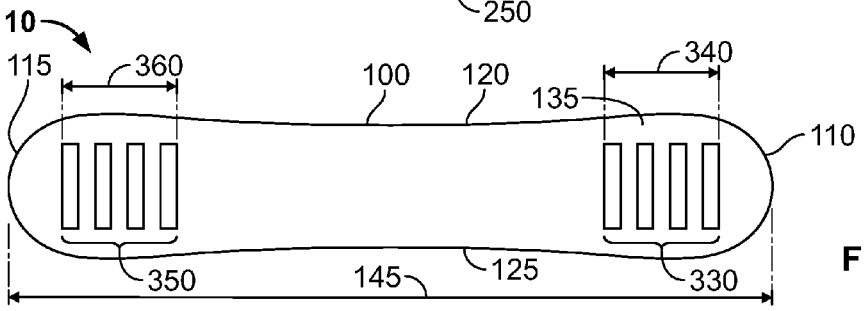
FIG. 5 shows a top view of the embodiment of FIG. 1.

FIG. 5 shows exercise apparatus 10, rigid elongated platform 100, rigid elongated platform first end 110, rigid elongated platform second end 115, rigid elongated platform first side 120, rigid elongated platform second side 125, rigid elongated platform top side 135, rigid elongated platform length 145, first end compartment array 330, first end compartment array length 340, second end compartment array 350 and second end compartment array length 360.

The compartment arrays are disposed at both ends of the rigid elongated platform 100 such that there is space in the middle of the rigid elongated platform 100 for a user to stand. The combined length of the compartment arrays ranges from 2 percent to 50 percent of the length of the rigid elongated platform, with each compartment array length being 1 percent to 25 percent of the rigid elongated platform length. There may be from one to 10 compartments in each array. In FIG. 5, each compartment array shows four compartments. There may be one compartment in each array, two compartments in each array, three compartments in each array, or four compartments in each array. The number of compartments may differ between the two arrays, ie: there may be one compartment in one array and two compartments in the other array, for a total of three compartments on the rigid elongated platform, or any number of compartments desired in each array. The compartments may be spaced evenly as shown in FIG. 5, or they may be unevenly spaced or flush against each other without any space in between them.

Figure 6A:
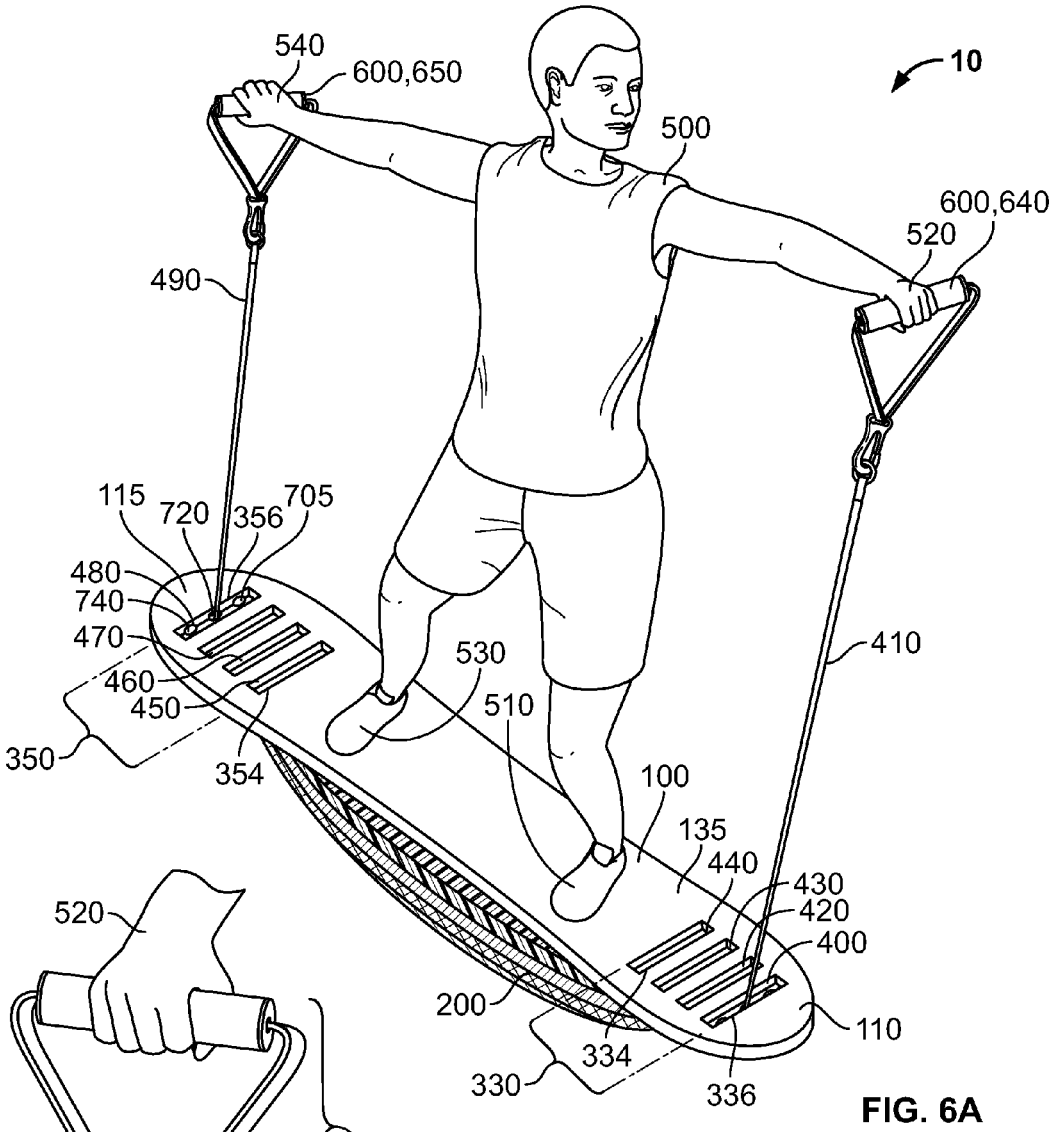
FIG. 6A shows a view of the embodiment of FIG. 1 in use.

FIG. 6A shows exercise apparatus 10, rigid elongated platform 100, rigid elongated platform first end 110, rigid elongated platform second end 115, rigid elongated platform top side 135, resilient balancing element 200, first end compartment array 330, first end compartment array proximate end 334, first end compartment array distal end 336, second end compartment array 350, second end compartment array proximate end 354, second end compartment array distal end 356, first compartment 400, first flexible element 410, second compartment 420, third compartment 430, fourth compartment 440, fifth compartment 450, sixth compartment 460, seventh compartment 470, eighth compartment 480, second flexible element 490, user 500, user first foot 510, user first hand 520, user second foot 530, user second hand 540, handle 600, first removable and interchangeable handle 640, second removable and interchangeable handle 650, first spindle housing 705, second spindle housing 720, and third spindle housing 740.

FIG. 6A shows the exercise apparatus 10 in use. The user 500 is shown standing on the rigid elongated platform 100 disposed on the resilient balancing element 200. He is grasping handles 600 that are attached to flexible elements 410 and 490. To use the exercise apparatus 10, the user can shift his weight to move the rigid elongated platform 100, using the resilient balancing element 200 as a counter force to cause him to keep shifting to retain his balance, thereby exercising the desired muscle groups. He can also perform arm exercises with the flexible elements, pulling them up or down, forward or backward, toward and away from his body, or some combination thereof.

The flexible elements are preferably tubes made from rubber or elastic. They may be solid or hollow, and they made be made from any material, including but not limited to, rubber, plastic, elastic, fabric, metal, glass, wood, graphene, or any combinations of these materials with each other or with other materials. The flexibility of the tubes is such that they can be grasped by a user and pulled to perform exercises, and they will rebound back to their original state. The length of the tubes is from 6 inches to 120 inches (15.2 to 304.8 cm), with a preferred length range of 24 inches to 90 inches (61.0 to 228.6 cm).

Figure 7A:
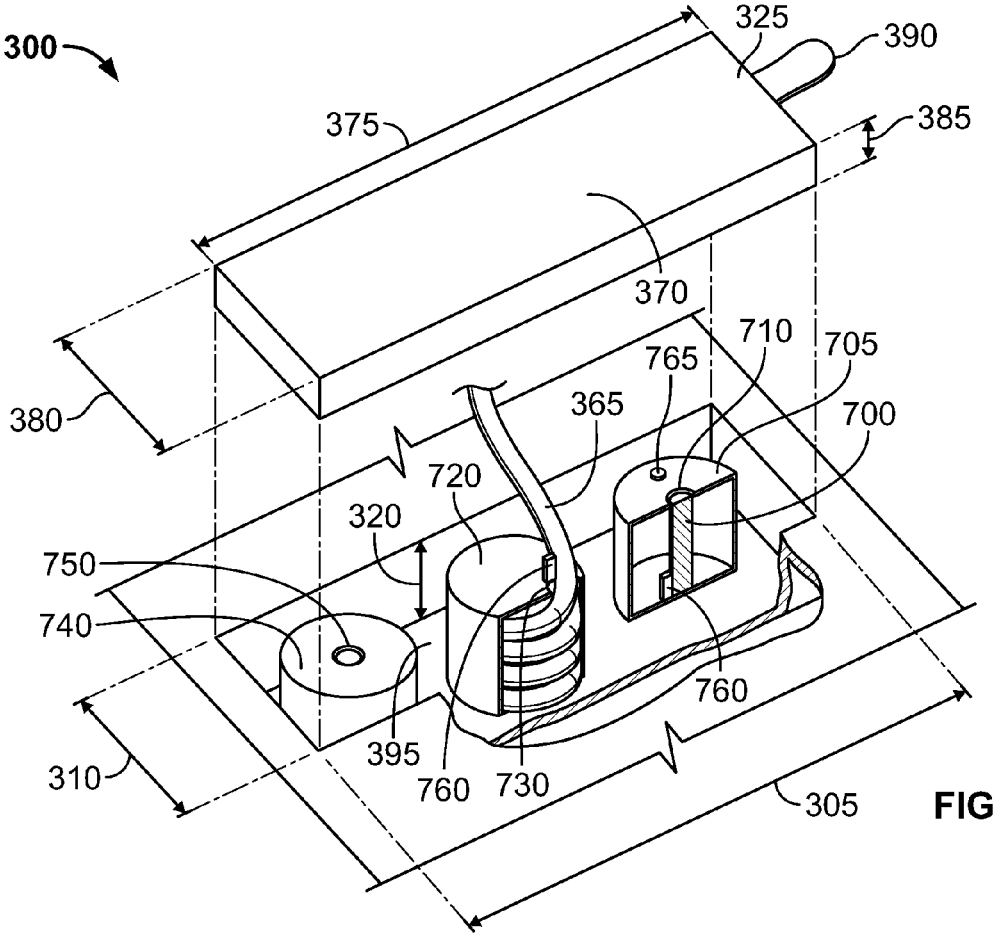
FIG. 7A shows a view of the hollow of a compartment with retractable flexible elements.

In the figures, each compartment contains three spindle housings (shown in detail in FIG. 7A). Although multiple compartments are shown, each containing three spindle housings that are disposed linearly in one direction, (ie., parallel to the user's feet as shown in the figure), the multiple compartments may be combined into one larger compartment that contains spindle housings in both linear directions, for instance 12 spindle housings, in four rows of three spindle housings each, the rows being parallel to the user's feet as shown in the figure. Alternately, there may be two larger compartments, each housing two rows of spindle housings, or any number of spindle housings. Any combination of compartments and number of spindle housings may be disposed on the rigid elongated platform.

The disposition of many spindle housings on the rigid elongated platform allows many different users to benefit from the exercise apparatus, and for many different exercises to be performed correctly, because the flexible elements are disposed correctly in relation to the user's body. For instance, the user shown in FIG. 6A is roughly six feet tall. He is using the flexible elements disposed in the first end compartment array distal end 336 and the second end compartment array distal end 356. These flexible elements are spaced correctly so he works the correct muscles in the proper form. A smaller person would need to use the flexible elements that are disposed closer to the proximate ends of the exercise apparatus to ensure proper form. A user and/or their trainer could determine the best way for any size person to use the invention.

One problem in performing physical therapy exercises and exercises in general is that a user may perform them incorrectly, particularly where tools are used, such as machines or weights. When performed incorrectly, the exercises can do more harm than good because they stress the muscles in the wrong way and can strain them. For instance, a five foot tall person may use a machine or tool for arm strengthening that was designed to fit a taller person. When they use the tool, the arms may be extended too far, and the joints or muscles may be damaged. The present invention solves that problem by allowing multiple users to find the correct form using the properly spaced flexible elements.

As can be seen in FIG. 6A as well, the user may select to use flexible elements that are disposed closer to one side of the rigid elongated platform than to the other side. This would be desirable for a number of exercises, such as cross body stretching, lateral press, etc.

Figure 6B:
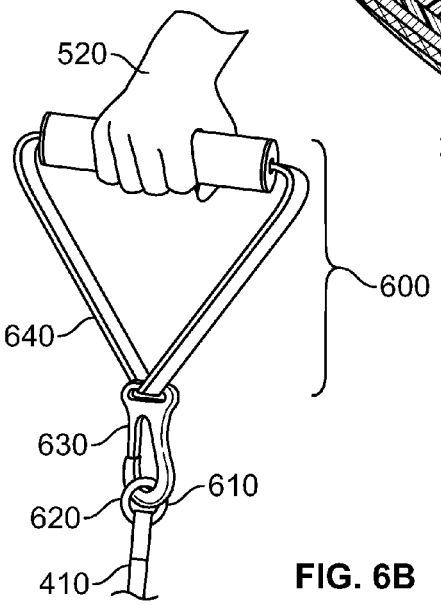
FIG. 6B shows an expanded view of a handle.

FIG. 6B shows handle 600, flexible element/handle interface 610, flexible element joining loop 620, flexible element/handle joining member 630, first removable and interchangeable handle 640, first flexible element 410 and user first hand 520.

The handle is attached to the flexible element using a method that allows it to be removed and replaced. The preferred embodiment for a general handle is shown in FIG. 6B, but a handicapped person or a person with a disease such as arthritis may not be able to grasp the handle shown. In that case, the handle may be removed and be replaced with a handle customized to the needs of the user.

In order to change the handle, one would remove it at the flexible element/handle joining member 630 or at the flexible element/handle interface 610. The flexible element would then be disposed on the new handle at the same point. FIG. 6B illustrates one example of a joining mechanism; one can appreciate that any mechanism that achieves the same purpose may be used.

In an alternate embodiment, the handle and flexible element may be one integral piece, and the user may have various flexible elements with different handles permanently attached.

FIG. 7A shows compartment 300, compartment length 305, compartment width 310 compartment depth 320, compartment top 325, flexible element 365, compartment cover 370, compartment cover length 375, compartment cover width 380, compartment cover depth 385, cover release tab 390, compartment hollow space 395, spindle 700, first spindle housing 705, first spindle housing opening 710, second spindle housing 720, second spindle housing opening 730, third spindle housing 740, third spindle housing opening 750, retraction device 760, and retraction device button 765.

FIG. 7A illustrates a preferred embodiment of the invention. In FIG. 7A, the compartment cover 370 has been removed using the release tab 390 to show the compartment hollow space 395. The compartment cover length 375, compartment cover width 380, and compartment cover depth 385 are such that the cover fits flush inside the compartment. The dimensions of the compartment length 305, the compartment width 310 and compartment depth 320 depend on the number of spindle housings disposed in the compartment, and the size of the spindle housings.

The first spindle housing 705 has been cut away to show a spindle 700 without a flexible element disposed on it; in this view the spindle and retraction mechanism are visible.

The second spindle housing 720 has been cut away to show the flexible element disposed on the spindle. The third spindle housing 740 has been shown as it would typically be seen by a user. The spindle housings may have removable tops, may have hinged or otherwise openable sections, or may come off completely to allow access to the flexible elements and to the retraction mechanisms.

The retraction mechanism may be any device which allows the flexible element to be retracted into the housing and onto the spindle after it has been extended out. Retraction mechanisms include, but are not limited to, manual retraction, mechanical retraction, hydraulic retraction, electrical retraction devices, or any method of retracting a hose or tube. The retraction mechanism may have a stop on it to stop the flexible element from retracting at a certain point; the stop may be adjustable. The retraction device may be activated by the retraction device button 765 shown on the cut away view of the first spindle housing 705, or it may be activated electronically using a hard wired or wireless signal or by yanking on the flexible element. The retraction device may be attached to the flexible element or to the spindle or to both.

The second spindle housing 720 shows a flexible element disposed on a spindle (spindle not visible in this view). When a user wants to use a flexible element, he removes the compartment cover 370 by pulling on the cover release tab 390 and pulls the flexible element 365 out through the spindle housing opening. When the user is done, he activates the retraction device 760 and the flexible element is retracted onto the spindle. The retraction device is shown on the bottom of the first spindle housing 705 and on the top of the second spindle housing 720; the retraction device may be disposed anywhere on the spindle or spindle housing, or anywhere in the compartment.

Figure 7B:
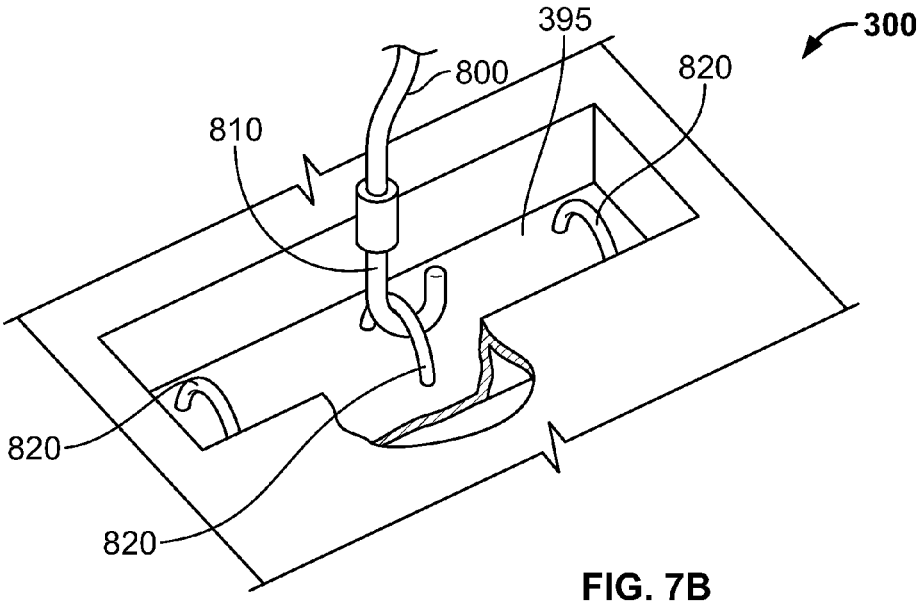
FIG. 7B shows a view of the hollow of a compartment with a detachable flexible element.

FIG. 7B shows compartment 300, compartment hollow space 395, detachable flexible element 800, detachable flexible element joining mechanism 810 and rigid elongated platform joining device 820.

FIG. 7B shows an alternate embodiment of the invention. In FIG. 7B, the detachable flexible element 800 is not disposed in the compartment 300 until the user desires to use the exercise apparatus. In this case, the compartment when not in use contains rigid elongated platform joining devices 820; there may be any number disposed in any configuration within one or more compartments. Different length flexible elements may be employed with this embodiment, depending on the user.

To use this embodiment, the user removes the compartment cover as in FIG. 7A and hooks the detachable flexible element 800 onto the detachable flexible element joining mechanism 810. Although shown as a ring and a hook, any device, system, or mechanism may be used for the detachable flexible element joining mechanism 810, including rings with clips, hooks with hooks, or any device, system or mechanism which achieves the desired result.

Figure 8:
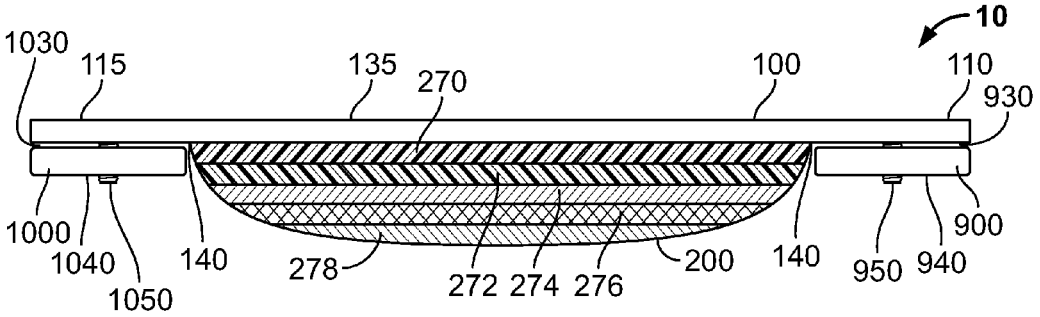
FIG. 8 shows a side view of an embodiment with weight attachments.

FIG. 8 shows exercise apparatus 10, rigid elongated platform 100, rigid elongated platform first end 110, rigid elongated platform second end 115, rigid elongated platform top side 135, rigid elongated platform bottom side 140, resilient balancing element 200, resilient balancing element first pattern 270, resilient balancing element second pattern 272, resilient balancing element third pattern 274, resilient balancing element fourth pattern 276 and resilient balancing element fifth pattern 278, rigid elongated platform first end weight attachment 900, rigid elongated platform first end weight attachment top 930, rigid elongated platform first end weight attachment bottom 940, rigid elongated platform first end weight attachment joining mechanism 950, rigid elongated platform second end weight attachment 1000, rigid elongated platform second end weight attachment top 1030, rigid elongated platform second end weight attachment bottom 1040 and rigid elongated platform second end weight attachment joining mechanism 1050.

FIG. 8 illustrates the use of weight attachments on the exercise apparatus. A user may attach weights to the rigid elongated platform to increase the difficulty of his workout. The weights may be available in a variety of pounds, and may be attached by any method, including but not limited to, screwing or clamping them on, or any method that would allow them to be attached.

Figure 9:
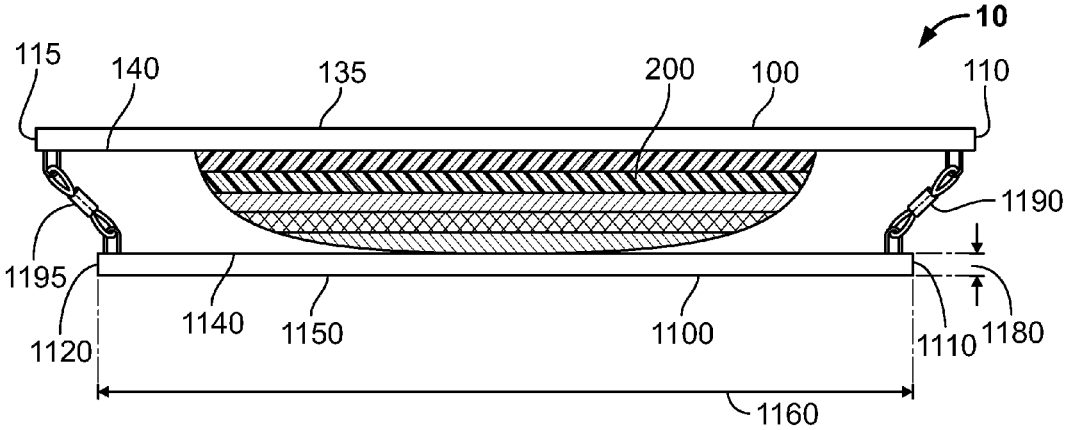
FIG. 9 shows a side view of an embodiment with an auxiliary rigid elongated platform.

FIG. 9 shows exercise apparatus 10, rigid elongated platform 100, rigid elongated platform first end 110. rigid elongated platform second end 115, rigid elongated platform top side 135, rigid elongated platform bottom side 140, resilient balancing element 200, auxiliary rigid elongated platform 1100, auxiliary rigid elongated platform first end 1110, auxiliary rigid elongated platform second end 1120, auxiliary rigid elongated platform top side 1140, auxiliary rigid elongated platform bottom side 1150, auxiliary rigid elongated platform length 1160, auxiliary rigid elongated platform depth 1180, auxiliary rigid elongated platform first end joining mechanism 1190 and auxiliary rigid elongated platform second end joining mechanism 1195.

FIG. 9 shows an embodiment that would be useful for a beginner, or someone who finds it difficult to balance. An auxiliary rigid elongated platform is disposed under the resilient balancing element to add more stability. This may be made from any material as described above for the rigid elongated platform. The two may be made from the same or different materials or combinations thereof. They may be the same length or differing lengths, with the auxiliary elongated platform shorter than the elongated platform as shown, or vice versa.

The auxiliary rigid elongated platform first end joining mechanism 1190 and auxiliary rigid elongated platform second end joining mechanism 1195 are shown as clips; they may be any device, mechanism or method that allows the rigid elongated platform 100 and the auxiliary rigid elongated platform 1100 to be joined with the resilient balancing element 200 between them.

FIGS. 8 and 9 taken together again illustrate how the present invention may benefit users of all ability levels. A strong athletic person would add weights as in FIG. 8, while a non-athletic person or someone with poor balance would add the auxiliary rigid elongated platform as in FIG. 9.

Figure 10:
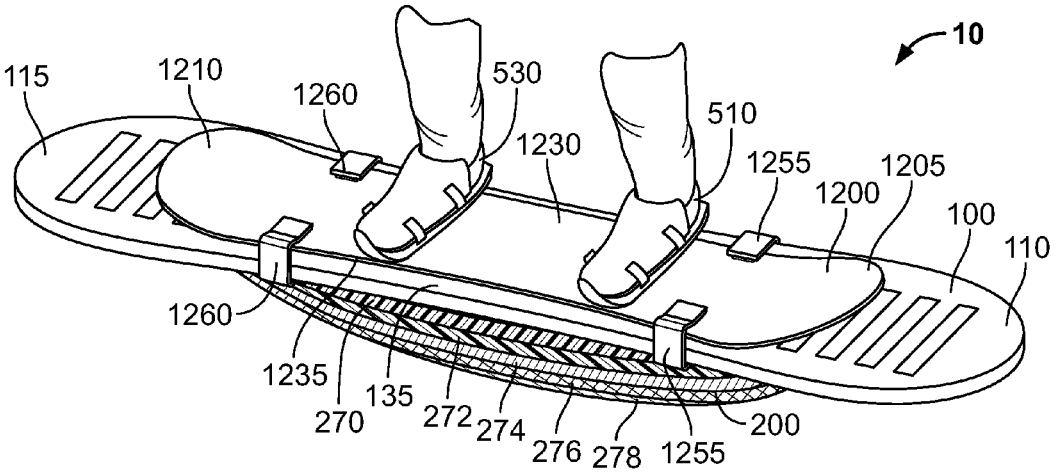
FIG. 10 shows a top perspective view of the embodiment of FIG. 1 with an activity board.

FIG. 10 shows exercise apparatus 10, rigid elongated platform 100, rigid elongated platform first end 110, rigid elongated platform second end 115, rigid elongated platform top side 135, resilient balancing element 200, resilient balancing element first pattern 270, resilient balancing element second pattern 272, resilient balancing element third pattern 274, resilient balancing element fourth pattern 276 and resilient balancing element fifth pattern 278, user first foot 510, user second foot 530, activity board 1200, activity board first end 1205, activity board second end 1210, activity board top side 1230, activity board bottom side 1235, activity board first joining mechanism 1255 and activity board second joining mechanism 1260.

An accomplished athlete or a beginning snow boarder would benefit from being able to practice in a safe way with his own board. The joining mechanisms shown in FIG. 10 allow any user to practice his activity using the desired activity board and the present invention. Because the present invention is close to the ground and is more controllable by a user than a free form board on a surface such as snow, ice, water, gravel, etc., it's much safer to practice an activity as shown in the figure. In order to use the activity board with the present invention, the user would join his activity board 1200 to the rigid elongated platform 100. The joining mechanisms are shown as clamps in the figure, but they could be any device, mechanism or method that would allow the activity board to be joined to the rigid elongated platform.

In a comparison of FIG. 10 to FIG. 8, the use of the patterns 270, 272, 274, 276, and 278 disposed on the resilient balancing element 200 to indicate stability levels is shown. In FIG. 8, the resilient balancing element 200 is fully inflated, and the patterns are clearly shown. In FIG. 10, the resilient balancing element 200 is partially deflated, as can be seen by the smaller surface areas of the patterns when compared to those in FIG. 8. Therefore, the exercise apparatus 10 is less stabile in FIG. 8 than it is in FIG. 10, and the user can easily determine the stability level by simply looking at the exercise apparatus.

Figure 11A:
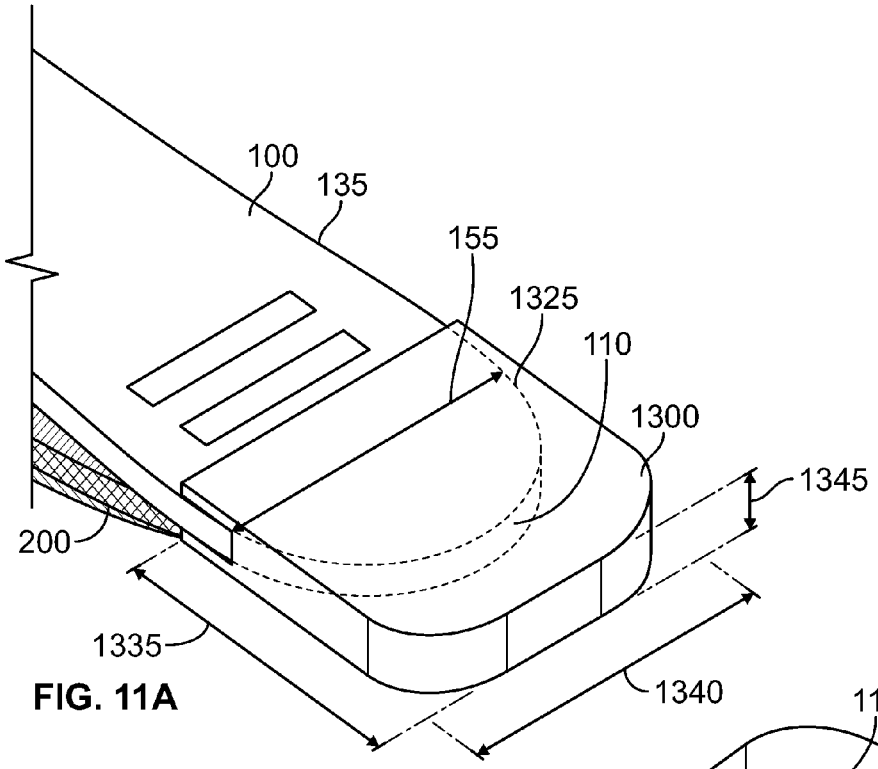
FIG. 11A shows a top perspective expanded view of an embodiment with an extension device.

FIG. 11A shows rigid elongated platform 100, rigid elongated platform first end 110 rigid elongated platform top side 135, rigid elongated platform widest width 155, resilient balancing element 200, rigid elongated platform first end extension device 1300, rigid elongated platform first end extension device top side 1325, rigid elongated platform first end extension device length 1335, rigid elongated platform first end extension device width 1340 and rigid elongated platform first end extension device depth 1345.

FIG. 11A shows how the rigid elongated platform 100 may be extended by adding extension devices. A user may add an extension device on one end or both ends of the rigid elongated platform. The extension device depth 1345 is such that if fits over the end of the rigid elongated platform, the extension device width 1340 is such that it is at least as wide as the rigid elongated platform widest width 155.

It may extend the rigid elongated platform length from one inch to 24 inches. The extension device may be made from any materials, including those listed for the rigid elongated platform.

A user may want to extend the rigid elongated platform to extend the range of exercises done with it, for instance, if the user wants to lie down on the platform for specific activities. Additionally, a very tall user such as a basketball player may need to extend the rigid elongated platform to accommodate his stance.

Figure 11B:
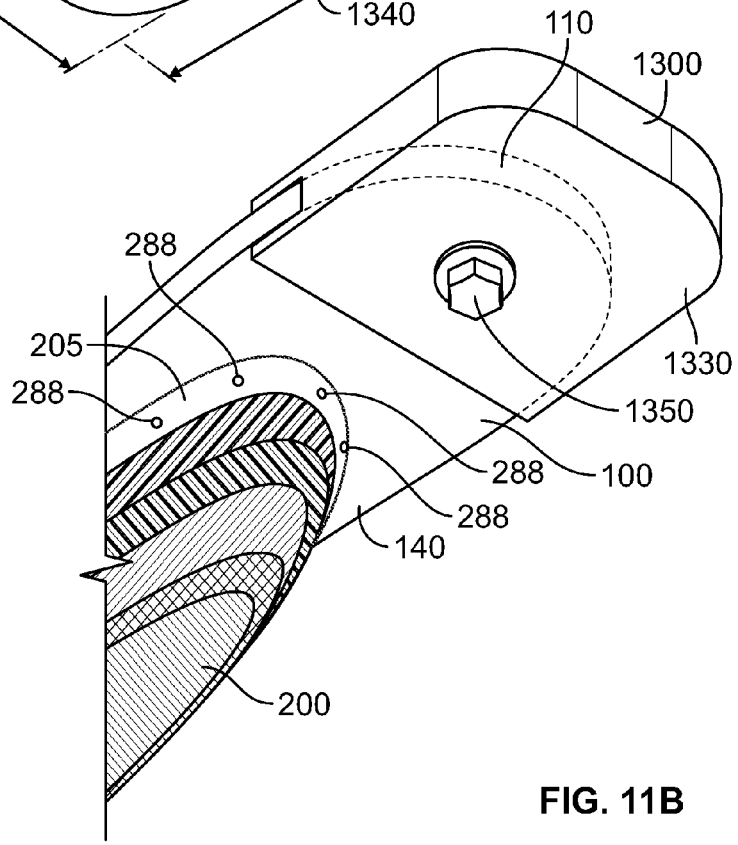
FIG. 11B shows a bottom perspective expanded view of the embodiment of FIG. 11A with an extension device.

FIG. 11B shows rigid elongated platform 100, rigid elongated platform first end 110, rigid elongated platform bottom side 140, resilient balancing element 200, resilient balancing element top surface 205, rivets 288, rigid elongated platform first end extension device 1300, rigid elongated platform first end extension device bottom side 1330 and rigid elongated platform first end extension device joining mechanism 1350.

FIG. 11B shows the extension device attached to the rigid elongated platform using an extension device joining mechanism 1350. Although shown as a bolt, it may be any device, mechanism, or method that allows the extension device to be joined to the rigid elongated platform.

FIG. 11B also shows a method of attaching the resilient balancing element 200 to the rigid elongated platform 100. In the figure, the resilient balancing element top surface 205 is joined to the rigid elongated platform 100 using rivets 288. Although shown as a method using rivets, the two may be joined using any device, mechanism, or method that allows the extension device to be joined to the rigid elongated platform.

Figure 12:
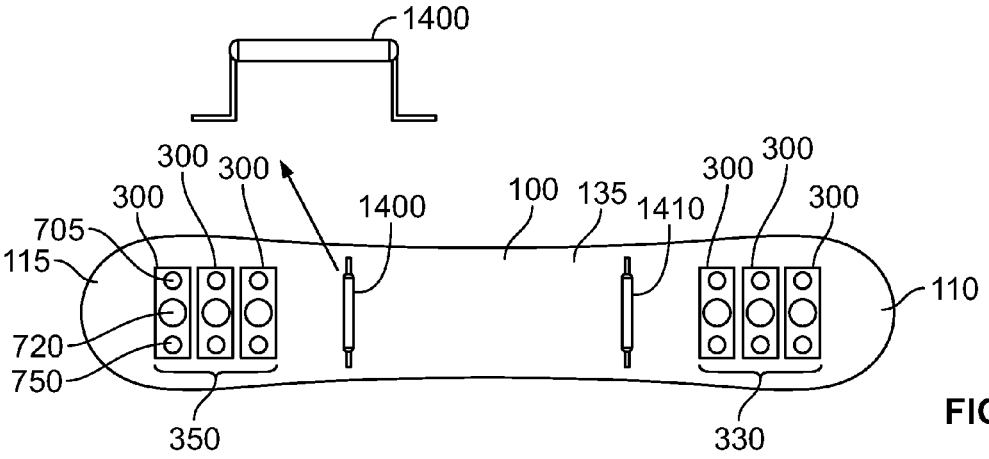
FIG. 12 shows a top view of an embodiment with rigid elongated platform handles.

FIG. 12 shows rigid elongated platform 100, rigid elongated platform first end 110, rigid elongated platform second end 115, rigid elongated platform top side 135, first end compartment array 330, second end compartment array 350, rigid elongated platform first removable handle 1400 and rigid elongated platform second removable handle 1410.

FIG. 12 shows the exercise apparatus with removable handles. The addition of handles allows another range of exercises to be done with the device. This adds to the novelty of this invention, as other similar devices in the field lack this utility.

In FIG. 12 the compartments 300 are shown without covers. The spindle housings 705, 720 and 750 hold the spindles and flexible elements in place. This view also illustrates that the spindle housings, and therefore the spindles, may be of different sizes within a compartment.

Figure 13:
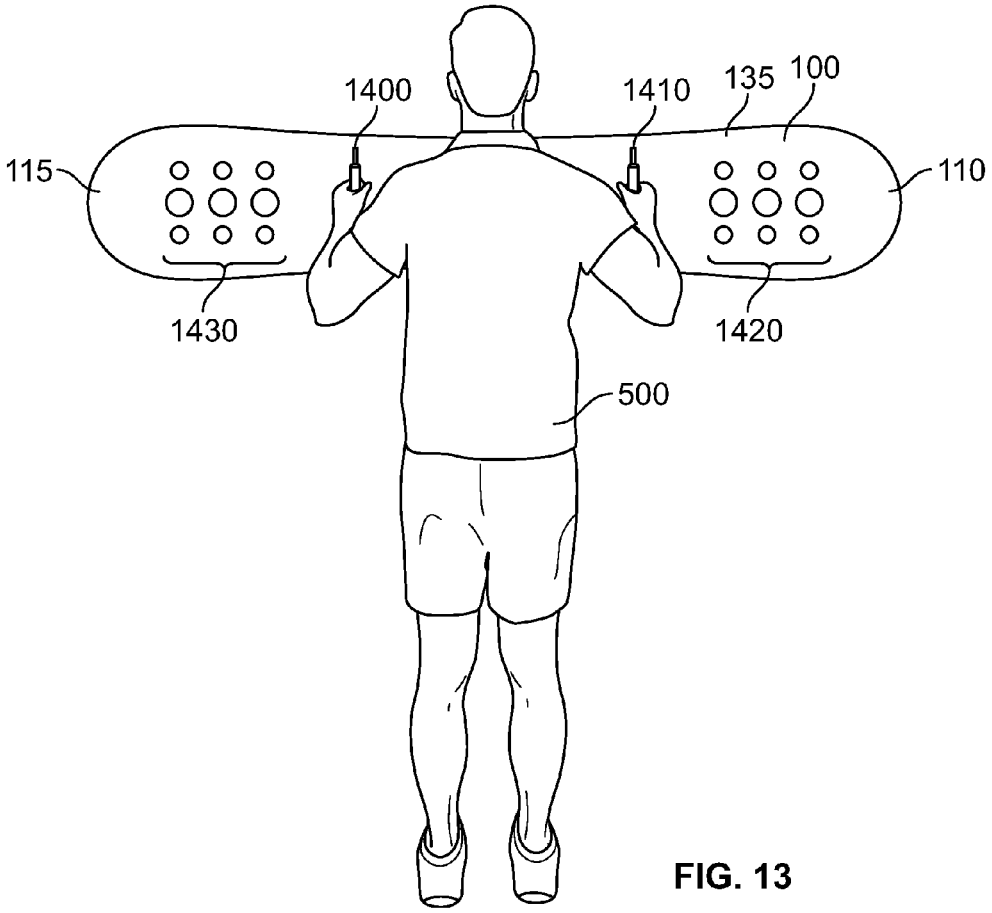
FIG. 13 shows the embodiment of FIG. 12 in use.

FIG. 13 shows rigid elongated platform 100, rigid elongated platform first end 110, rigid elongated platform second end 115, rigid elongated platform top side 135, user 500, rigid elongated platform first removable handle 1400, rigid elongated platform second removable handle 1410, first end flexible element recess array 1420 and second end flexible element recess array 1430.

FIG. 13 shows the exercise apparatus with removable handles in use. The user has grasped handles 1400 and 1410 to perform push ups, lifted the apparatus off the floor, and may now perform a number of different exercises with it. If desired, he can add the weights from FIG. 8 or any of the other removable devices discussed above to modify his workout.

FIG. 13 also shows flexible elements without the compartments. They are disposed on the rigid elongated platform using just the spindle housings and spindles. This embodiment may also be used with the rigid elongated platform joining devices 820 shown in FIG. 7B.

Figure 14:
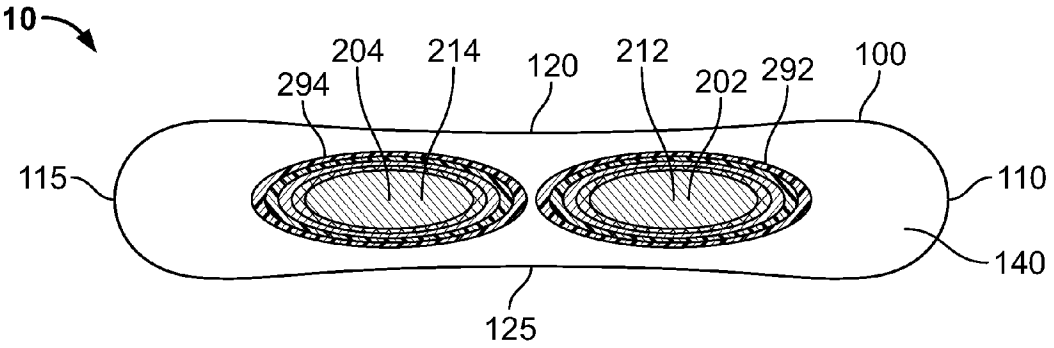
FIG. 14 shows a bottom view of an alternate embodiment of the invention.

FIG. 14 shows the exercise apparatus with the resilient balancing element composed of multiple component elements, from a bottom view. Shown is the exercise apparatus 10, rigid elongated platform 100 with rigid elongated platform first end 110, rigid elongated platform second end 115, rigid elongated platform first side 120, rigid elongated platform second side 125, and rigid elongated platform bottom side 140. Also shown is first resilient balancing element 202, second resilient balancing element 204, first resilient balancing element bottom surface 212, second resilient balancing element bottom surface 214, first rigid elongated platform and resilient balancing element union 292, and second rigid elongated platform and resilient balancing element union 294.

FIG. 14 shows two resilient balancing elements side by side. There may be two or more resilient balancing elements disposed as shown, or disposed in any orientation on the rigid elongated platform bottom side 140. The figure shows the two resilient balancing elements as completely separate components; they may be as shown, or may contact each other such that there is one or more shared walls between them. There may be an array of resilient balancing elements, and they may be a different size than shown. For instance, there may be twelve smaller resilient balancing elements in three rows of four disposed on the rigid elongated platform bottom side, either sharing walls, each standing alone, or some combination thereof. The multiple resilient balancing elements may be of differing sizes and shapes, such that some are shaped as shown and some are more or less rounded than those shown or are other shapes. The resilient balancing elements may cover any part of the rigid elongated platform bottom side, from a one millimeter diameter portion disposed anywhere on the rigid elongated platform bottom side, to the entire surface of the rigid elongated platform bottom side, and all coverages in between.

Figure 15:
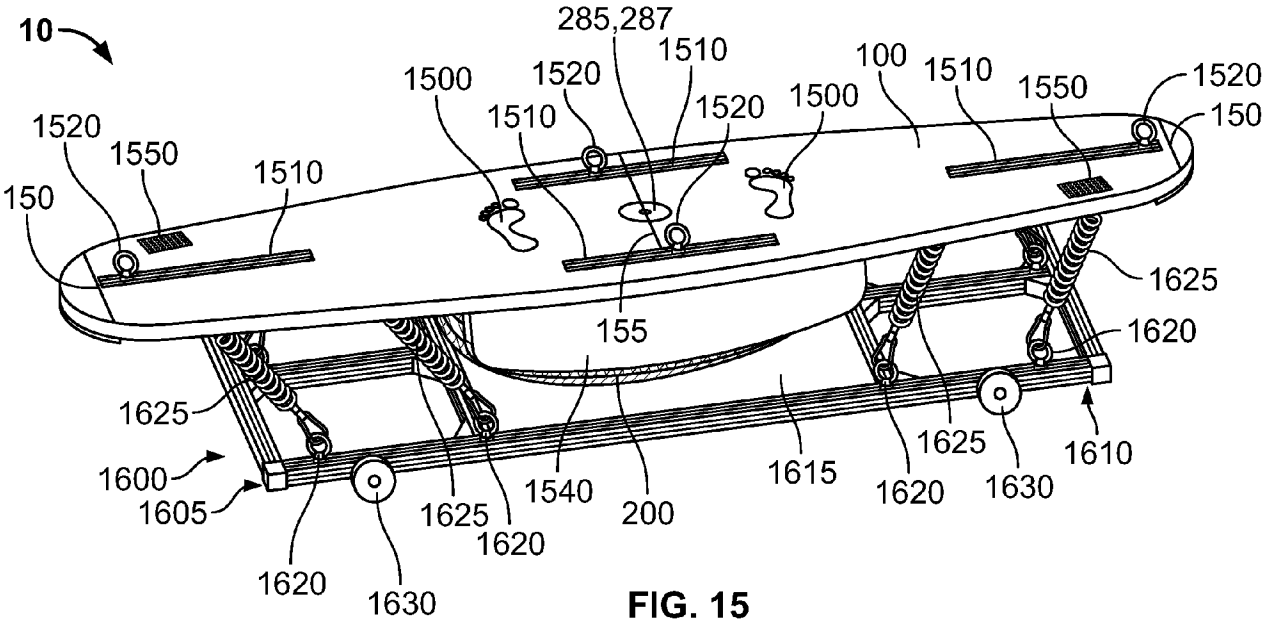
FIG. 15 shows a top perspective view of an alternate embodiment of the invention.

FIG. 15 shows a top perspective view of an alternate embodiment of the invention. Shown in FIG. 15 is the exercise apparatus 10, with the rigid elongated platform 100 that has rigid elongated platform narrowest width 150 and rigid elongated platform widest width 155, and the resilient balancing element 200. The rigid elongated platform 100 contains valve 285, pressure gauge 287, sensor 1500, compartment track 1510, compartment fastener 1520, stability skirt 1540, and readout device 1550. Connected to the rigid elongated platform is the stability base 1600, with stability base first end 1605, stability base second end 1610, stability base center 1615, stability base fastener 1620, stability base connector 1625, and stability base wheel 1630.

The narrowest width in this embodiment is at either end, with the widest width in the middle. The dimensions are approximately 1 inch to approximately 36 inches for the narrowest width 150, and approximately 6 inches to approximately 60 inches for the widest width 155. A valve 285 for inflating and deflating the resilient balancing element is in the center of the rigid elongated platform 100, but it can be placed anywhere on the rigid elongated platform that allows interfacing with the resilient balancing element. The valve is recessed into the rigid elongated platform and can pop up for use. A pressure gauge 287 can be incorporated with the valve to measure the pressure in the resilient balancing element, or it can be attached externally.

FIG. 15 also shows sensors 1500, which are placed near the center of the rigid elongated platform, although they can be anywhere on it. The sensors 1500 allow a user's parameter's to be sensed and measured. A user would stand on the rigid elongated platform 100, with his or her feet on the sensor indicators, and a measurement would be taken. The types of parameters measured may include, but not be limited to, heart rate, weight, bmi, and percent body fat. The data can be transmitted to a data device (shown in FIG. 17) or stored in the sensor component. The user may be barefoot or wearing shoes, as a wireless sensor may be employed to sense the signal through shoes or other clothing. The sensor indicators are shaped like feet in the figure, but they may be any indicia or shape.

The compartment track 1510 is used to allow a user to move the flexible elements (shown in FIG. 16) while exercising. These will be discussed in detail with FIG. 16, as will the compartment fastener 1520.

The stability skirt 1540 is a piece of material that is removably affixed to bottom side of the rigid elongated platform to add stability. The stability skirt extends from the rigid elongated platform to a position that is approximately 1/16 to 7/8 the height of the fully pressurized resilient balancing element, with the ideal position approximately 0.5 to 0.67 of the height of the fully pressurized resilient balancing element. If a user stands on the rigid elongated platform and moves it front to back, at a certain point the stability skirt 1540 will hit the floor and restrict the movement of the rigid elongated platform. This gives the user more confidence in the device and also helps them from falling if they tip the rigid elongated platform too far. The stability skirt may be made from any material, including but not limited to, wood, plastic, metal, fabric, or other materials or combinations of materials.

The stability base 1600 is used to further stabilize the exercise apparatus 10. The stability base is shown in more detail in FIG. 18. It is attached to the rigid elongated platform using stability base fasteners 1620 and stability base connectors 1625. The stability base fasteners may be round pins connected to the stability base as shown, or may be any other type of fastener that allows the stability base connectors to be attached to the stability base. The stability base fasteners may be integral or removable, and may retract to fit flush with the stability base. The stability base connectors may be springs as shown, or may be any other type of device that allows a connection between the rigid elongated platform and the stability base, such as but not limited to, metal coils, bands made of rubber or other material, rods, either collapsible or rigid, pressurized balls, or pneumatic valves. There may be any number of stability base connectors placed at any intervals, and different intervals for different regions of the exercise apparatus. The stability base connectors may be connected using the stability base fasteners, or they may be integral to the stability base, integral to the rigid elongated platform, or integral to both or neither.

The readout device 1550 may be an LED readout that shows data transmitted from the sensors, keeps a count of repetitions, or displays any other data desired. Although a digital LED is the preferred type of readout device, it may be any type of readout, including but not limited to, digital, analogue, with or without LED lights, or using a different type of indicator.

The stability base wheels may be retractable. They allow the exercise apparatus and stability base to be easily transported. There may be any number of wheels and they may be any type, made from any material. They may be casters, ball bearings, or any other type of device that allows the exercise apparatus to be easily transported.

Figure 16:
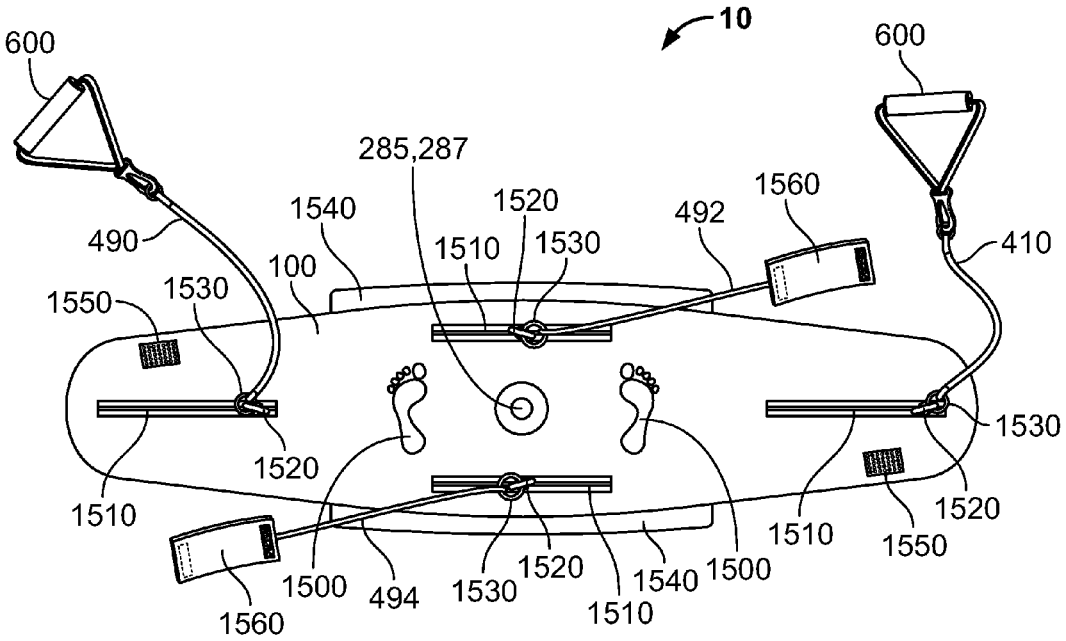
FIG. 16 shows a top view of an alternate embodiment of the invention.

FIG. 16 shows a top view of an alternate embodiment of the invention. Shown in FIG. 16 is the exercise apparatus 10, with the rigid elongated platform 100 and the resilient balancing element 200. The rigid elongated platform 100 contains valve 285, pressure gauge 287, sensor 1500, compartment track 1510, compartment fastener 1520, flexible element fastener 1530, stability skirt 1540, and readout device 1550. Attached to the rigid elongated platform is first flexible element 410, second flexible element 490, third flexible element 492, and fourth flexible element 494. The first and second flexible elements are connected to handles 600, and the third and fourth flexible elements are connected to ankle cuffs 1560.

FIG. 16 shows the flexible elements deployed with the rigid elongated platform. The flexible element fastener 1530 is integrally attached to the flexible element. It is removably attached to the compartment fastener 1520. The compartment fastener 1520 slides along the compartment track 1510, so that by grasping the handle 600 the user can move the flexible element back and forth along the compartment track. There may be one or more stops along the compartment track that may be integral or removably placed in the compartment track. Also shown deployed with the rigid elongated platform via the compartment track is the ankle cuff 1560. A user can wrap the ankle cuff around their ankle and move the flexible element along the compartment track. Although designed for use with the ankle, the ankle cuff may be used with any body part, such as a wrist or knee. The user may either be standing or sitting on the rigid elongated platform when using the flexible elements in this manner, or they may be standing or sitting on the ground, a chair, or a cushion, etc., near the rigid elongated platform. The user may use all four flexible elements at once, or may use only one, or may use one or more in conjunction with each other.

Although the flexible elements are shown attached to a compartment track, the element that allows them to be moved along the rigid elongated platform may be any type of component. For example, compartments are shown in FIG. 1 as a way to move the flexible elements on the rigid elongated platform, and the compartment track is shown in FIG. 15 as a way to move the flexible elements on the rigid elongated platform. There may be other components that may be employed as a way to move the flexible elements on the rigid elongated platform, such as but not limited to, using ball bearings, hooks, rotating disks, or any other type of device that achieves the desired movement and placement of the flexible elements.

Figure 17:
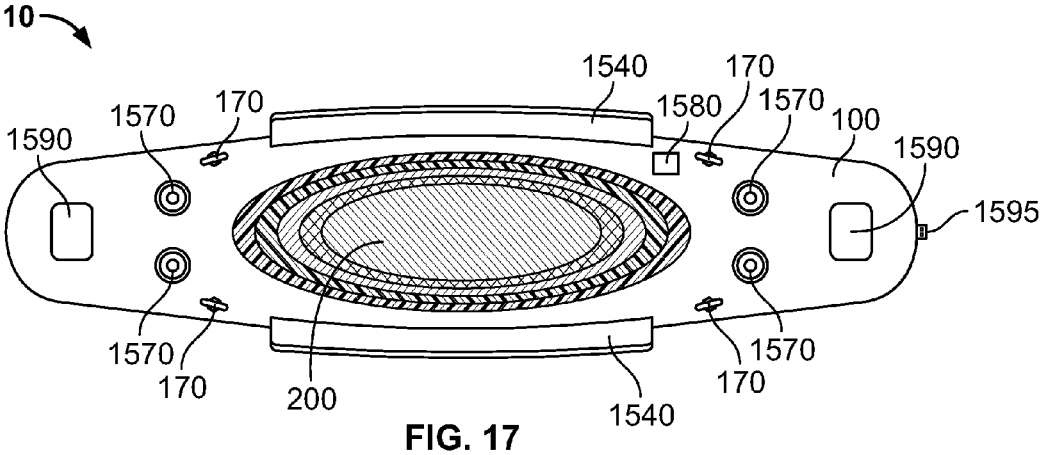
FIG. 17 shows a bottom view of an alternate embodiment of the invention.

FIG. 17 shows a bottom view of an alternate embodiment of the invention. Shown in FIG. 17 is the exercise apparatus 10, with the rigid elongated platform 100 and the resilient balancing element 200. The bottom of the rigid elongated platform contains speakers 1570, transceiver 1580, and vibrators 1590. Data device 1595 is shown at the end of the rigid elongated platform. Also shown are rigid elongated platform fasteners 170, and stability skirt 1540.

The speakers 1570 may be any type of sound emitting device. There may be four evenly spaced speakers as shown, or there may be any number of speakers placed anywhere on the exercise apparatus. The speakers may be on the bottom but also on the top or the sides.

The transceiver 1580 may be any device that will transmit and receive sound and work in conjunction with speakers, such as but not limited to, RF, a Bluetooth device etc. There may be one or more transceivers placed anywhere on the exercise apparatus, or embedded in the rigid elongated platform.

The vibrators 1590 may be placed anywhere on the device, and there may be one or more vibrators, placed apart or together. As stated earlier, the vibrators assist muscle growth.

The data device 1595 may be any type of device that collects or stores data, such as but not limited to, a USB drive. The exercise apparatus is shown with a USB drive protruding from a USB port, but any types of devices and ports may be used, or data may be transmitted wirelessly, and the ports may be anywhere on the exercise apparatus.

Any of the components described above may be made to retract into the rigid elongated platform or to be embedded in it.

The rigid elongated platform fastener 170 is attached to the bottom of the rigid elongated platform to allow for attachment of the stability base connector 1625 (shown in FIG. 15). It may be any type of connector, and may be integral with the rigid elongated platform or removable. Although there are four shown, there may be any number of rigid elongated platform fasteners placed anywhere on the bottom of the rigid elongated platform.

Figure 18:
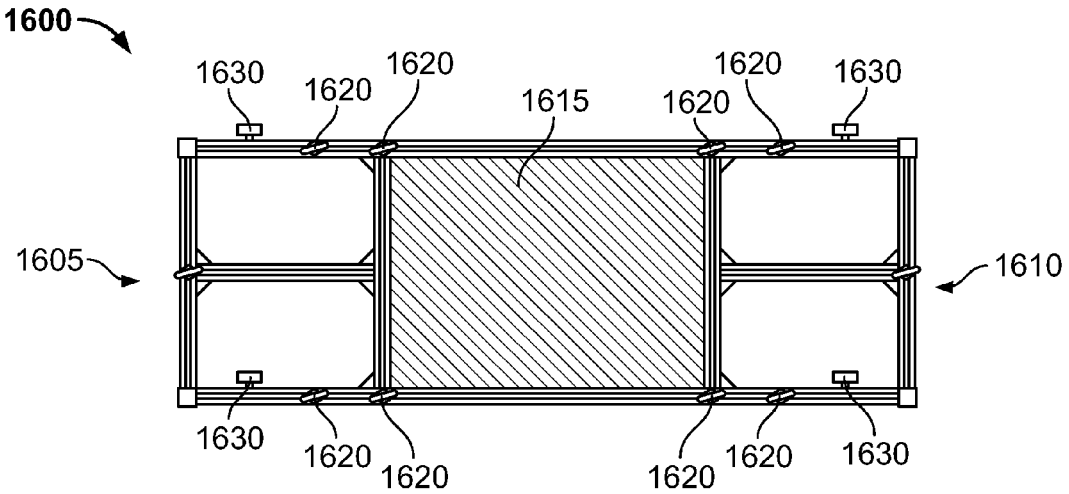
FIG. 18 shows a top view of the stability base element of the invention.

FIG. 18 shows a top view of the stability base element of the invention. Shown is stability base 1600, with stability base first end 1605, stability base second end 1610, stability base center 1615, stability base fastener 1620, and stability base wheel 1630. The stability base center may be a vibration plate, a standard plate, or may be left open.

Figure 19A:
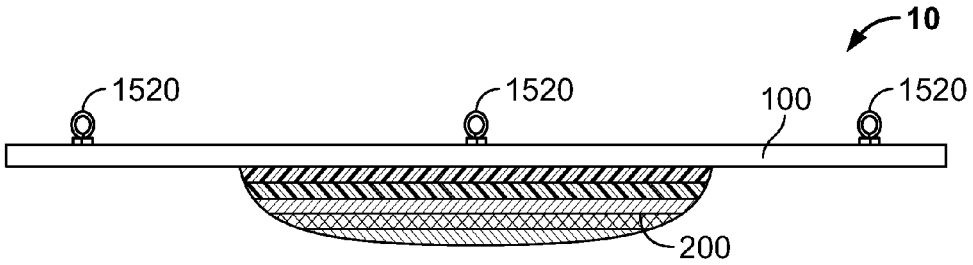
FIG. 19A shows a side view of the invention with the resilient balancing element fully pressurized.

FIG. 19A shows a side view of the invention with the resilient balancing element fully pressurized. Shown in FIG. 19A is the exercise apparatus 10, with the rigid elongated platform 100 and the resilient balancing element 200 and compartment fasteners 1520. As can be seen in FIG. 19A, the resilient balancing element has been fully pressurized and the rigid elongated platform is as far off of the ground as possible. This presents the most challenging exercise for the user, and is for use by advanced users.

Figure 19B:
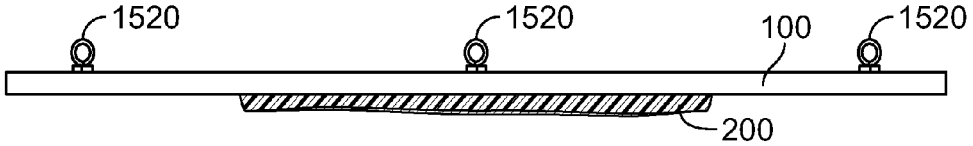
FIG. 19B shows a side view of the invention with the resilient balancing element de-pressurized.

FIG. 19B shows a side view of the invention with the resilient balancing element de-pressurized. Shown in FIG. 19B is the exercise apparatus 10, with the rigid elongated platform 100 and the resilient balancing element 200 and compartment fasteners 1520. As can be seen in FIG. 19B, the resilient balancing element may be fully depressurized. This presents the least challenging exercise for the user, and may be used for beginners.

The resilient balancing element may be employed as shown in FIGS. 19A and 19B, and with all pressurizations in between. In all pressurizations, the exercise apparatus may be used for exercising by standing on the rigid elongated platform using the flexible elements, or by using the attached flexible elements from a position on the floor or on a chair.

Figure 19C:
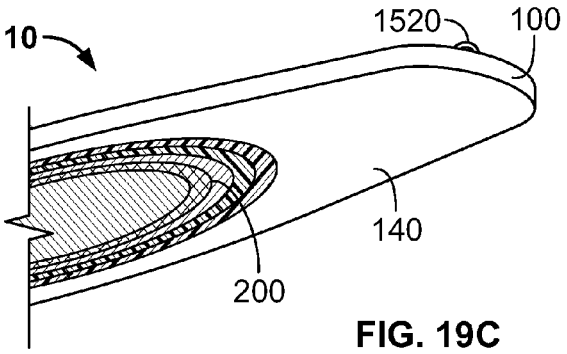
FIG. 19C shows a bottom perspective view of the invention.

FIG. 19C shows a bottom perspective view of the invention. Shown in FIG. 19C is the exercise apparatus 10, with the rigid elongated platform 100 and the resilient balancing element 200, rigid elongated platform bottom side 140 and compartment fasteners 1520. FIG. 19C shows the resilient balancing element fused to the rigid elongated platform, so they are integral with each other. They may be fused using any method, including but not limited to, heat fusion, chemical fusion, or any other process.

The exercise apparatus may be personalized by adding stickers, etc. Additionally, it may be used as a source of advertising.

The many elements of the present invention make it unique in the field. The novelty is illustrated by the various options for nearly every aspect of the invention that allow it to be used in the proper exercise form by a variety of users, both in terms of body size and fitness level. Additionally, there is a wide range of exercises available to any user of the present invention, and users can perform exercises that use the upper and lower extremity muscle groups simultaneously.

Figure 20:
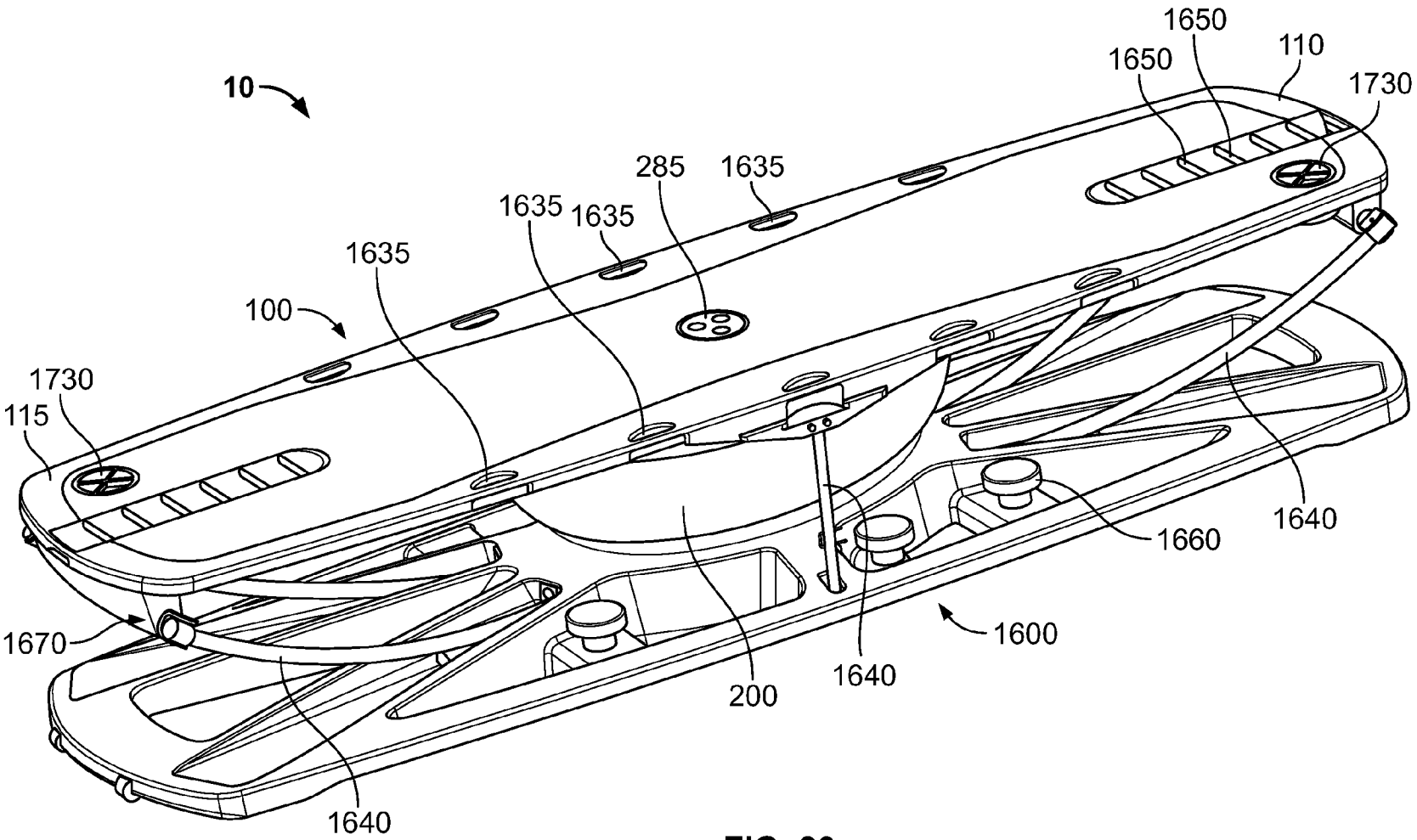
FIG. 20 is a perspective view of an alternate embodiment of the present invention.

Referring now to FIG. 20, there is an alternate embodiment of the present invention. The exercise device 10 generally has an elongated rigid platform 100, a stability base 1600 and a resilient balancing element 200. The elongated rigid platform 100 rests upon the resilient balancing element 200 and is coupled to stability bars 1640 which, in addition to the resilient balancing element 200, couples the elongated rigid platform 100 to the stability base 1600.

The elongated rigid platform 100 has a first end 110 and a second end 115 with a number of features disposed at each end and along the length of the platform. At each end, there is a wired or more preferably wireless speaker(s) 1730. These speakers 1730 are integrated into the platform surface and may operate off a number of wireless standards such as but not limited to Bluetooth®, Wi-Fi®, ANT®, ZigBee®, and the like or any combination thereof. Preferably the speakers 1730 have an on/off switch to control their usage. If one desires to not have or use integrated speakers, then speakers capable of wireless communication may be used in conjunction with the exercise device 100. A power source may reside therein (the platform) or may manifest itself in solar cells, external battery packs, and the like.

Further, the elongated rigid platform 100 provides for a number of apertures 1635 and attachment bars 1650. The apertures 1635 preferably are present along a part of or the entire length of the periphery of the platform. These apertures 1635 allow the coupling of secondary items such as ropes, resistance bands, and the like thereto. At each end of the platform, there are a series of attachment bars 1650. These bars provide a functional surface for the attachment of secondary objects as described with the apertures 1635. The attachment bars 1650 are spaced progressively outwards from the center of the platform to provide varying distances to which an object may be coupled.

The resilient balancing element 200 may be inflated or deflated as desired though the valve 285 in the platform. The increase or decrease in air pressure in the resilient balancing element 200 increases or decreases the stability experienced by a user present thereon.

The stability base 1600 has a number of features that operate in conjunction with the air pressure inside the resilient balancing element 200 to provide an increase or decrease in stability to the exercise device 10 as a whole. The stability base 1600 has a number of stability bars 1640 emanating therefrom. These stability bars 1640 are attached to the elongated rigid platform 100 at the attachment points 1670 as shown.

The tension knobs 1660 are used to progressively increase the tension in the stability bars 1640. By turning the tension knobs 1660 either clock wise or counter clock wise the stability bars 1640 may be subjected to one of as many as ten different stability or tension settings. Each bar may be adjusted independently to provide a particular feel or provide a particular targeted workout for a user. In some embodiments there are a total of six stability bars 1640 which includes two on each end of the exercise device 10 and two located in the central area of the device (one on each side).

As a whole, the exercise device 10 provides for a highly customized and tailed workout for a user who may be receiving on-going sports training, physical therapy, and the like. As described, there are a number of attachment points for a variety of equipment and multiple mechanisms (balancing element, stability bars) that can enhance the workout received by the user. Some examples of practical uses of the exercise device 10 are described below and shown in FIGS. 21 and 22.

Figure 21:
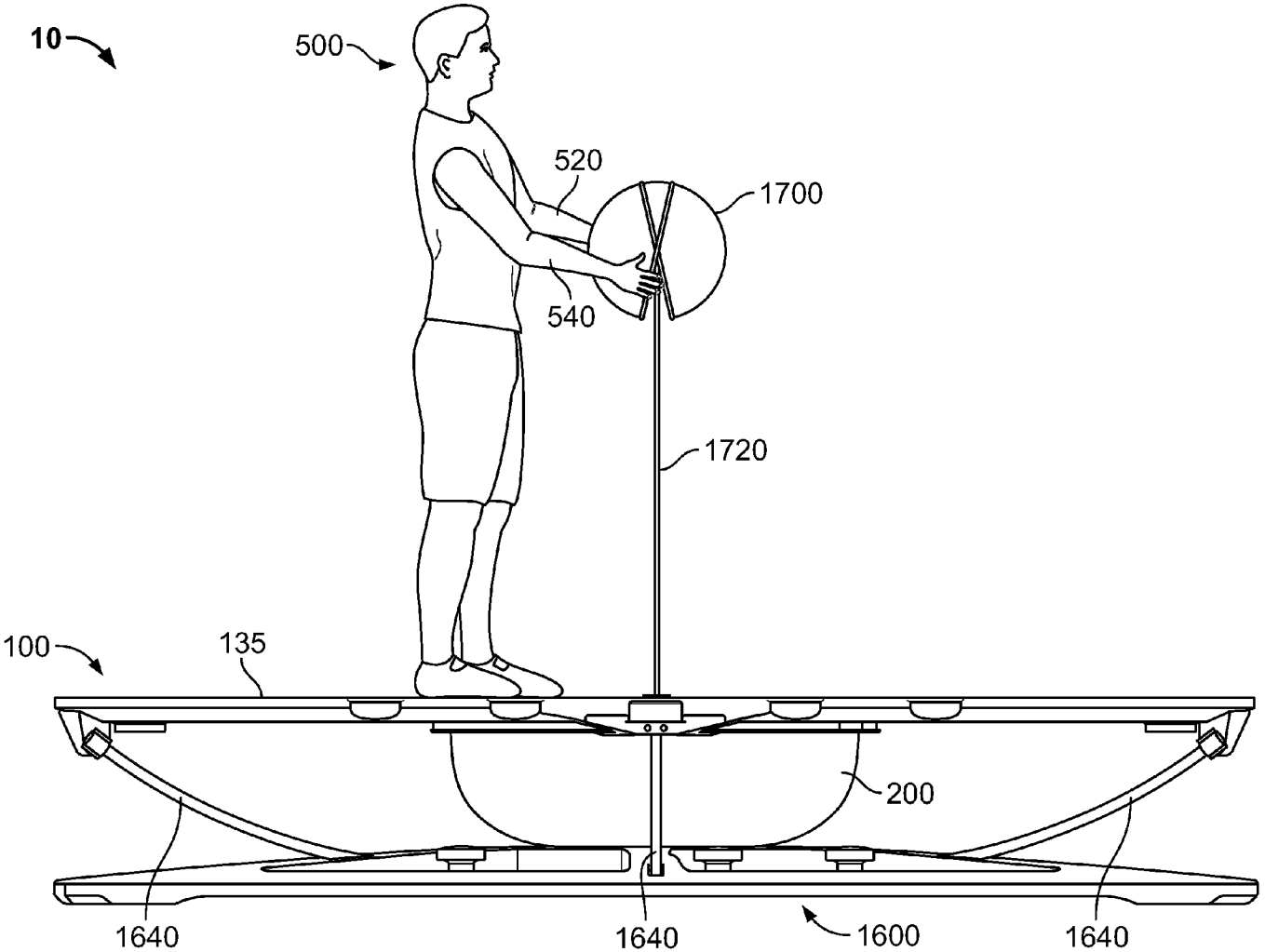
FIG. 21 is a side view of the embodiment shown in FIG. 20 with a user thereon performing an exercise.

Referring now to FIG. 21, there is a user 500 positioned upon the top side 135 of the rigid elongated platform 100 of the exercise device 10. The rigid elongated platform 100 is supported by a resilient balancing element 200 which sits upon a stability base 1600. The stability bars 1640 provide additional stabilization for the user 500. Attached to one of the apertures 1635 (see FIG. 20) is a resistance band 1720 which terminates at a resistance ball 1700. The resistance ball 1700 may be weighted, that is, comprise specific material or combinations of material to achieve a specific weight, and can be used primarily for core based exercises. The resistance ball 1700 may also be sport specific ball such as a basketball, football, volleyball, or the like. Other types of exercises may also be achieved by the user 500.

The resistance band 1720 may be coupled to any of the apertures as previously described and in some instances there may be multiple resistances bands coupled to the same or different apertures thereby influencing the force and directionality of the resistance experienced by the user 500.

Figure 22:
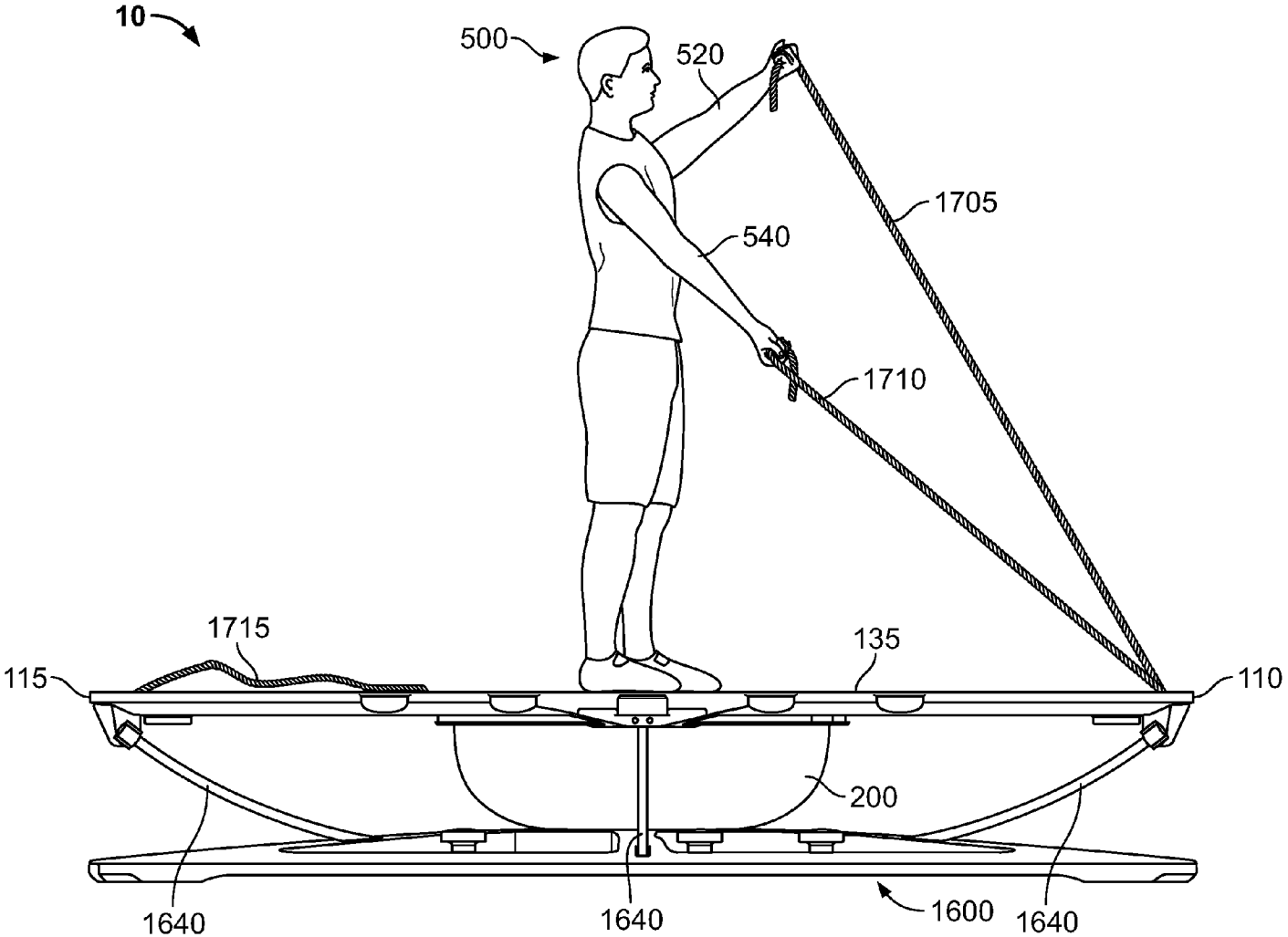
FIG. 22 is a side view of the embodiment shown in FIG. 20 with a user thereon performing an alternate exercise.

In FIG. 22, a first rope 1705, second rope 1710, and third rope 1715 have been coupled to the exercise apparatus 10. Preferably, these ropes are weighted so that each rope has a specific weight which is the same or different as any of the other ropes. The ropes are preferably coupled to the attachment bars 1650 (see FIG. 20) but may be coupled to any suitable structure on the exercise device 10. The ropes may be coupled to the attachment bars in any combination of positions to achieve the desired exercise results.

In one scenario, the user 500 keeps their arms straight as they stand upon the top surface 135 of the elongated rigid platform 100. The user 500 may stand facing the ropes, as shown, to facilitate an upper body workout. As noted, the weights of the ropes may be increased for an increase in difficulty. Further, the distance of coupling (to an attachment bar or other structure) of each rope may influence the difficulty of the workout.

In another example, the user 500 utilizes one rope coupled to each side of the elongated rigid platform 100 and the corresponding structure (i.e. attachment bars). The user 500 would stand laterally on the top surface 135 of the platform and perform upper body exercises. The stability bars 1640, resilient balancing element, and stability base 1600 can all be utilized to provide an increase in difficulty to the exercise(s). The above examples of exercises to be performed are merely exemplary and virtually any exercise targeting any specific muscle or muscle group may be performed in conjunction with embodiments of the present invention.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. An article of manufacture comprising:

a rigid elongated platform with a top side, a bottom side, a first end and a second end, wherein said rigid elongated platform has a plurality of apertures extending along at least a part of a periphery of said rigid elongated platform;

a resilient balancing element having an inner surface, an outer surface, a top surface, a bottom surface, and a volume, wherein said resilient balancing element top surface is coupled to said rigid elongated platform bottom side, and wherein said resilient balancing element being adjustable in volume;

a stability base coupled to a bottom surface of said resilient balancing element such that said resilient balancing element is positioned between said stability base and said rigid elongated platform, wherein the stability base has a plurality of stability bars that couple said stability base to said rigid elongated platform;

wherein the plurality of stability bars are independently adjustable to provide differing levels of stabilization of the rigid elongated platform; and more than one attachment bars positioned at said first end and/or said second end of said rigid elongated platform.

2. The article of manufacture of claim 1 further comprising at least one speaker operably coupled to the article of manufacture.

3. The article of manufacture of claim 2 wherein said speakers are wireless speakers.

4. The article of manufacture of claim 1 further comprising a valve disposed in said rigid elongated platform thereby providing access to change said volume of said resilient balancing element.

5. The article of manufacture of claim 1 wherein the plurality of stability bars are arced and coupled to a central portion of the stability base on a first end and coupled to an end of the rigid elongated platform on a second end.

6. The article of manufacture of claim 1 wherein adjustment of the plurality of stability bars provides a different degree of resistance on a first lateral side of the rigid elongated platform with respect to a second lateral side of the rigid elongated platform.

7. The article of manufacture of claim 1 further comprising at least one tension knob rotatably coupled to said stability base.

8. The article of manufacture of claim 7 wherein rotation of said at least one tension knob 5 increases or decreases the tension exhibited by said plurality of stability bars on said rigid elongated platform.

9. The article of manufacture of claim 8 wherein each of said at least one tension knobs increases or decreases the tension of one of said plurality of stability bars.

10. The article of manufacture of claim 1 wherein there are at least five attachment bars.

11. The article of manufacture of claim 10 wherein said at least five attachment bars are spaced at varying distances from a central area of said rigid elongated platform.

12. An article of manufacture comprising:

a rigid elongated platform having a top side, a bottom side, a first end, and a second end, wherein said rigid elongated platform has a plurality of apertures extending along at least a part of a periphery of said rigid elongated platform;

a resilient balancing element having an inner surface, an outer surface, a top surface, a bottom surface, and a volume, wherein said resilient balancing element top surface is coupled to said rigid elongated platform bottom side, and wherein said resilient balancing element being adjustable in volume;

a stability base coupled to a bottom surface of said resilient balancing element such that said resilient balancing element is positioned between said stability base and said rigid elongated platform, wherein the stability base has a plurality of stability bars that couple said stability base to said rigid elongated platform, wherein rotation of at least one tension knob rotatably coupled to the stability base increases or decreases tension exhibited by one or more of said plurality of stability bars with respect to said rigid elongated platform, wherein the plurality of stability bars are independently adjustable to provide differing levels of stabilization of the rigid elongated platform via the at least one tension knob; and a plurality of attachment bars positioned at said first end and/or said second end of said rigid elongated platform.

13. The article of manufacture of claim 12 wherein exercise equipment is removably coupled to said plurality of apertures and/or said plurality of attachment bars.

14. The article of manufacture of claim 12 wherein the plurality of stability bars are arced and coupled to a central portion of the stability base on a first end and coupled to an end of the rigid elongated platform on a second end.

15. The article of manufacture of claim 12 wherein adjustment of the plurality of stability bars provides a differing degree of resistance on a first lateral side of the rigid elongated platform with respect to a second lateral side of the rigid elongated platform.

* * * * *